US007083266B2

(12) United States Patent
Ahne et al.

(10) Patent No.: US 7,083,266 B2
(45) Date of Patent: Aug. 1, 2006

(54) MICRO-MINIATURE FLUID JETTING DEVICE

(75) Inventors: Adam Jude Ahne, Lexington, KY (US); John Douglas Anderson, Lexington, KY (US); Stephen Andrew Budelsky, Lexington, KY (US); Mark Joseph Edwards, Lexington, KY (US); Randall David Mayo, Georgetown, KY (US); George Keith Parish, Winchester, KY (US); Kristi Maggard Rowe, Richmond, KY (US); David Craig Stevenson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 471 days.

(21) Appl. No.: 10/284,066

(22) Filed: Oct. 30, 2002

(65) Prior Publication Data

US 2004/0085399 A1 May 6, 2004

(51) Int. Cl.
*B41J 2/005* (2006.01)

(52) U.S. Cl. ..... 347/59
(58) Field of Classification Search ..... 347/20, 347/50, 54, 56–59, 68, 4
See application file for complete search history.

(56) References Cited

U.S. PATENT DOCUMENTS

| | | | |
|---|---|---|---|
| 4,412,232 | A | 10/1983 | Weber et al. |
| 4,500,895 | A | 2/1985 | Buck et al. |
| 4,611,219 | A | 9/1986 | Sugitani et al. |
| 4,746,936 | A | 5/1988 | Takahashi |
| 4,748,460 | A | 5/1988 | Piatt et al. |
| 4,758,849 | A | 7/1988 | Piatt et al. |
| 5,501,535 | A | 3/1996 | Hastings |
| 5,552,813 | A | 9/1996 | Takada et al. |
| 5,610,635 | A | 3/1997 | Murray et al. |
| 5,634,730 | A | 6/1997 | Bobry |
| 5,646,660 | A | 7/1997 | Murray |
| 5,689,296 | A | 11/1997 | Heitmann |
| 5,842,793 | A | 12/1998 | Katayama et al. |
| 5,861,877 | A | 1/1999 | Kagayama et al. |
| 5,907,130 | A | 5/1999 | Suzuki |

(Continued)

FOREIGN PATENT DOCUMENTS

| | | |
|---|---|---|
| EP | 036295 A2 | 9/1981 |
| EP | 703086 | 3/1996 |
| EP | 890439 | 1/1999 |
| JP | 61-172751 | 8/1986 |
| JP | 02-235665 | 9/1990 |
| JP | 03-133663 | 6/1991 |
| WO | WO 9105665 | 5/1991 |
| WO | WO 9216375 | 10/1992 |

*Primary Examiner*—Huan Tran
(74) *Attorney, Agent, or Firm*—Luedeka, Neely & Graham, P.C.

(57) ABSTRACT

A micro-miniature fluid ejecting device. The fluid ejecting device includes a semiconductor substrate having fluid ejectors formed on a surface of the substrate. A flexible circuit is fixedly attached to the semiconductor substrate. The flexible circuit has power contacts for providing power to the fluid ejectors. At least one drive circuit is connected to the fluid ejectors. The drive circuit is disposed on one of the semiconductor substrate and the flexible circuit. A fluid sequencer is connected to the drive circuit for selectively activating the fluid ejectors. The fluid sequencer is also disposed on one of the semiconductor substrate and the flexible circuit. The semiconductor substrate is attached to a housing. A fluid source is provided for supplying fluid to the semiconductor substrate for ejection by the fluid ejectors. The fluid ejecting device provides low cost construction for application specific miniature fluid jetting devices.

33 Claims, 21 Drawing Sheets

U.S. PATENT DOCUMENTS 5,936,648 A 8/1999 Minowa et al.
5,988,900 A 11/1999 Bobry
6,012,809 A 1/2000 Ikeda et al.
6,015,211 A 1/2000 Kinoshita et al.
6,062,686 A 5/2000 Kinoshita et al.
6,095,634 A 8/2000 Kishi
6,130,692 A 10/2000 Mochizuki et al.
6,137,507 A 10/2000 Inui et al.
6,196,674 B1 3/2001 Takemoto
6,229,565 B1 5/2001 Bobry
6,243,109 B1 6/2001 Ishinaga et al.
6,310,639 B1 10/2001 Kawamura et al.
6,318,828 B1 11/2001 Barbour et al.
6,394,575 B1 5/2002 Kent
6,406,121 B1 6/2002 Benjamin et al.
6,527,365 B1 * 3/2003 Silverbrook ..... 347/40
6,543,883 B1 * 4/2003 Dodd et al. ..... 347/58
2003/0122898 A1 * 7/2003 Beerling et al. ..... 347/57

* cited by examiner

MICRO-MINIATURE FLUID JETTING DEVICE

FIELD OF THE INVENTION

The invention relates to micro-miniature fluid jetting devices and in particular to construction and control techniques for manufacturing and operating micro-miniature fluid jetting devices.

BACKGROUND OF THE INVENTION

Micro-miniature fluid jetting devices are suitable for a wide variety of applications including hand-held ink jet printers, ink jet highlighters, ink jet air brushes, miniature evaporative coolers, and delivery of controlled quantities of medicinal fluids and purified water to precise locations. One of the challenges to providing such micro-miniature jetting devices on a large scale is to provide a manufacturing process that enables high yields of high quality jetting devices. Another challenge is to provide fluid jetting devices which are substantially self-contained with respect to control and operation of the nozzle actuators while enabling use of the jetting devices for a variety of specific applications. There is a need therefore, for improved control architecture for micro-miniature fluid jetting devices.

SUMMARY OF THE INVENTION

With regard to the foregoing and other objects and advantages the invention provides a micro-miniature fluid ejecting device. The fluid ejecting device includes a semiconductor substrate having fluid ejectors formed on a surface of the substrate. A flexible circuit is fixedly attached to the semiconductor substrate, the flexible circuit having power contacts for providing power to the fluid ejectors on the surface of the substrate. At least one drive circuit is connected to the fluid ejectors. The at least one drive circuit is disposed on one of the semiconductor substrate and the flexible circuit. A fluid sequencer is connected to the at least one drive circuit for selectively activating the fluid ejectors. The fluid sequencer is also disposed on one of the semiconductor substrate and the flexible circuit. The semiconductor substrate is attached to a housing. A fluid source is provided for supplying fluid to the semiconductor substrate for ejection by the fluid ejectors.

In another embodiment, the invention provides a micro-miniature fluid ejector head assembly. The head assembly includes a semiconductor substrate containing a plurality of fluid ejectors formed on a surface of the substrate. A flexible circuit is fixedly attached to the semiconductor substrate. The flexible circuit has power contacts for providing power to the fluid ejectors. At least one drive circuit is connected to the fluid ejectors. The at least one drive circuit is disposed on one of the semiconductor substrate and the flexible circuit. A fluid ejector sequencer is connected to the at least one drive circuit for selectively activating the fluid ejectors. The fluid sequencer is also disposed on one of the semiconductor substrate and the flexible circuit.

An advantage of the invention is that it provides a structure which significantly minimizes the manufacturing costs for micro-miniature fluid jetting devices. The invention also provides low cost, micro-miniature fluid ejecting devices which can be easily tailored for specific applications. Because all of the drivers, timing devices, and sequencers for the fluid ejectors are substantially permanently connected to one another, fewer mechanical contacts are required for operation of the devices. The term "substantially permanently" is used to indicate a connection that is intended to be connected only once, i.e., a hard wire connection. There is no provision for undoing the connections once they are made. Because fewer mechanical connections are required, construction tolerances and reliability of the devices are greatly improved.

BRIEF DESCRIPTION OF THE DRAWINGS

Further advantages of the invention will become apparent by reference to the detailed description of preferred embodiments when considered in conjunction with the drawings, wherein like reference characters designate like or similar elements throughout the several drawings as follows.

DETAILED DESCRIPTION OF THE INVENTION

Figure 1:
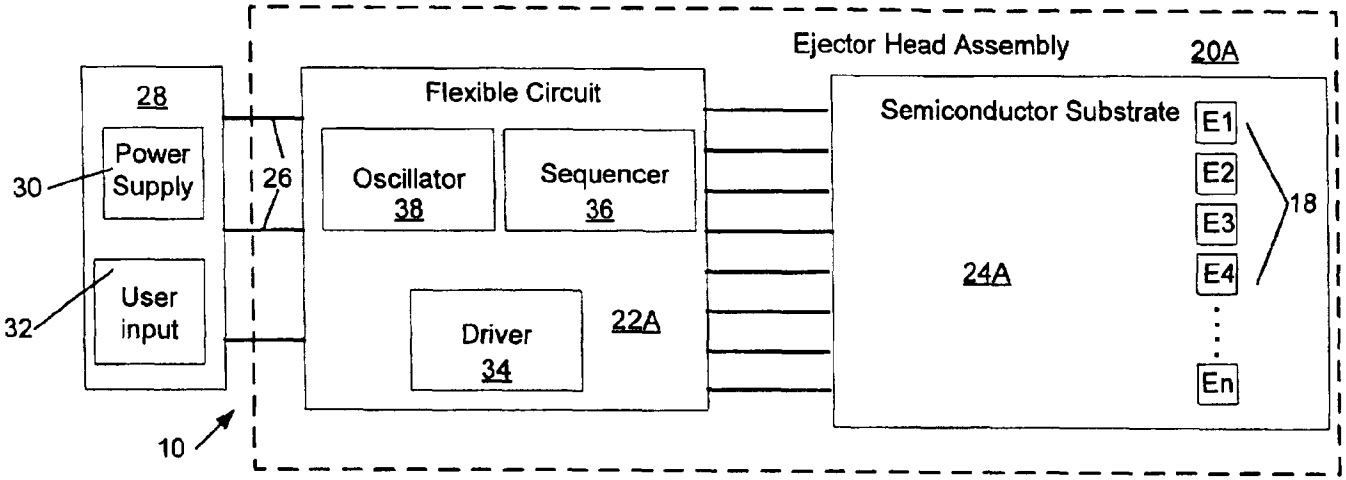
FIGS. 1–4 are representative schematic drawings of ejector head assemblies and power supplies therefor according to the invention.
Figure 2:
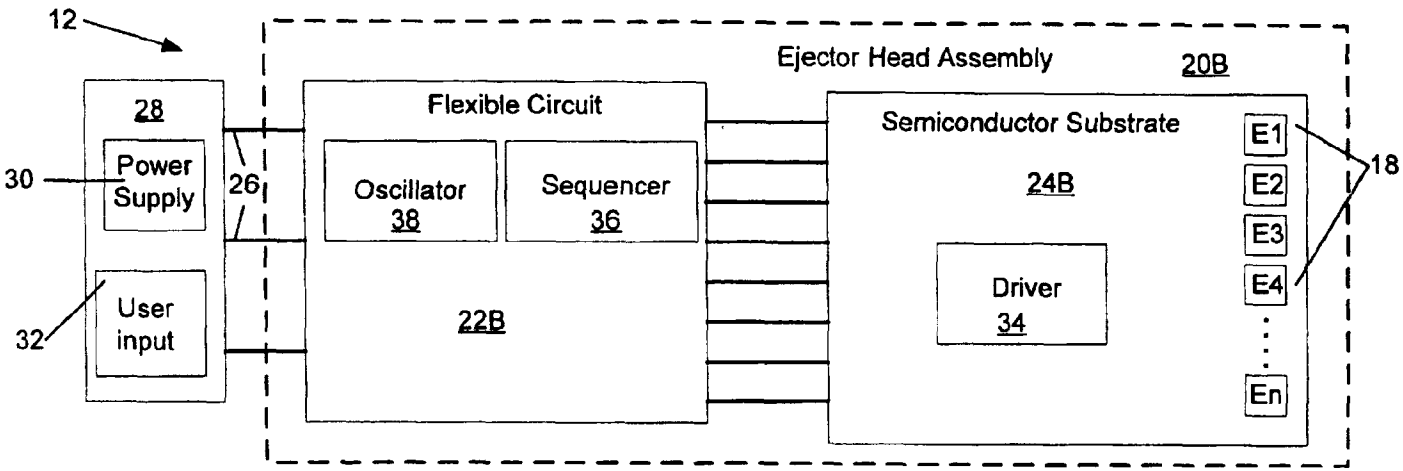
Figure 3:
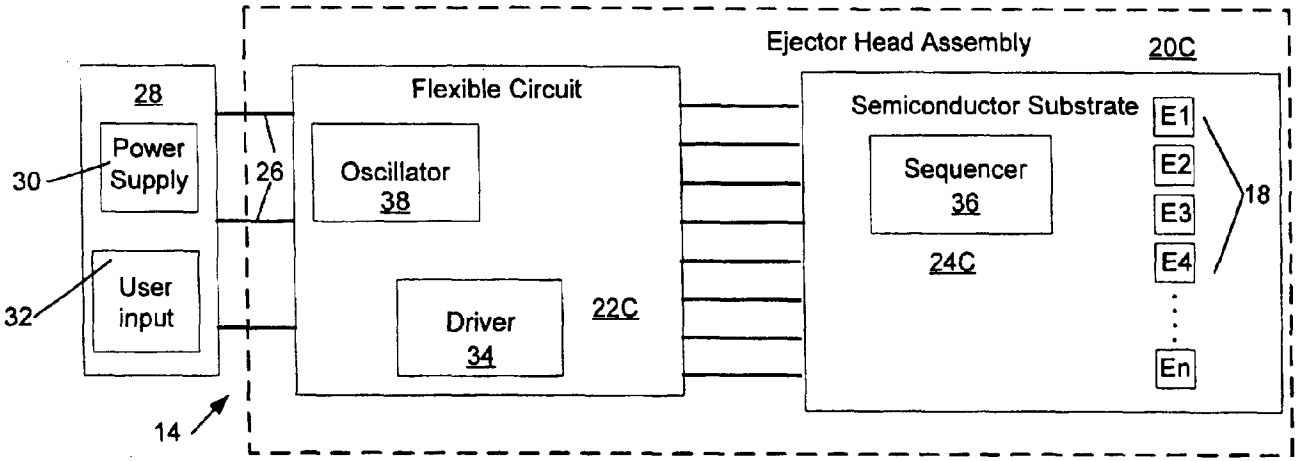
Figure 4:
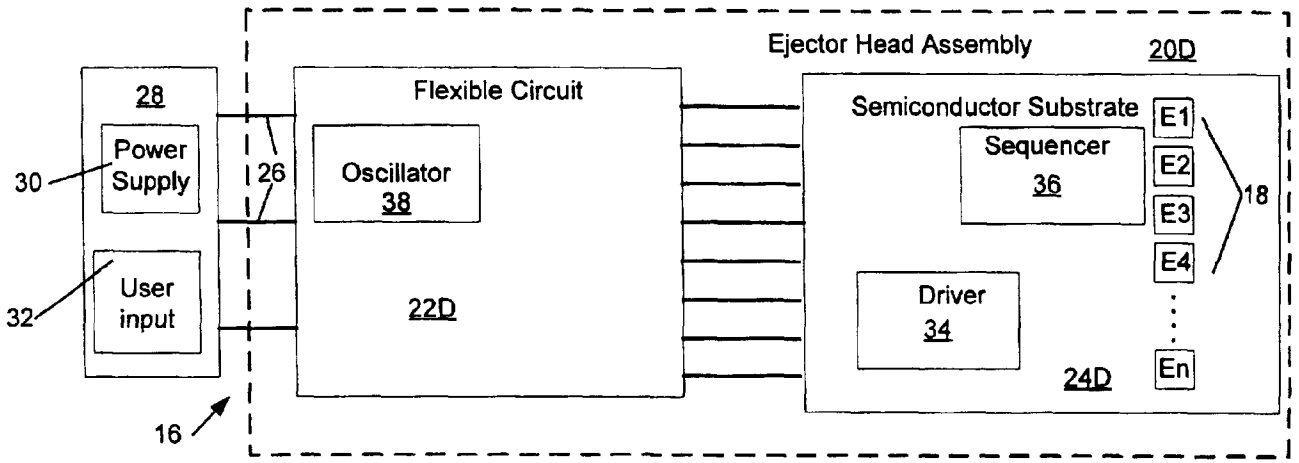

With reference to FIGS. 1–4, important aspects of the invention are illustrated. FIGS. 1–4 are schematic drawings of micro-miniature fluid ejector systems 10–16 illustrating application specific architecture for the systems. All of the control logic for operation of the ejectors 18 designated as E1, E2 . . . En is contained on the ejector head assembly 20A–20D which includes a flexible circuit 22A–22D and a semiconductor substrate 24A–24D. For the purposes of this invention, the term "flexible circuit" is intended to include a wide variety of flexible connections generally used in the micro-electronics industry including, but not limited to tape automated bonding (TAB) circuits and wire bond circuits. The ejectors may be thermal ejectors or piezoelectric ejectors such as typically used in ink jet printing devices.

As few as two or three connections, indicated as lines 26 are provided between a power source 28 and the ejector head assembly 20A–D thereby reducing the number of mechanical contacts required to operate the ejectors 18. By reducing the number of mechanical contacts, production tolerances and alignment problems are greatly reduced thereby lowering the cost of production of the ejector systems 10–16.

As described in more detail below, the power source 28 may include a power supply 30, such as a battery, and one or more user inputs 32. The power source 28 is connected to the ejector head assembly 20A–D by conventional contact connections. However, only as few as two or three contacts represented by lines 26 may be required for operation of the systems. That is because all of the drivers 34, sequencers 36, oscillators 38, and other operational logic devices are self-contained on the ejector head assemblies 20A–D as illustrated, for example, in FIGS. 1–4. For example, the drivers 34, sequencers 36, oscillators 38, etc. may all be located on the flexible circuit 22A–D, all in the semiconductor substrate 24A–D, or on the flexible circuit 22A–D and in the semiconductor substrate 24A–D as illustrated in FIGS. 1–4. It will be recognized that other components such as delay circuits, clock circuits, and the like may be provided with the understanding that the ejector systems 10–16 are substantially self-contained and do not require data input from devices not permanently connected to the substrate 24A–D or flexible circuit 22A–D for operation of the ejectors 18.

Unlike conventional ink jet printers having a substantially infinite number of ejection sequences, the systems 10–16 of the invention have a finite number of ejection sequences that can be used. Depending on the applications or uses of the systems 10–16, necessary activation logic for firing the ejectors 18 is pre-programmed into the ejector head assemblies 20A–D providing application specific devices. A plurality of ejection sequences may be pre-programmed into the devices and the user inputs 32 may be used to select the desired sequence(s). The sequences can be stored in a non-volatile memory on the semiconductor substrate 24A–D or can be hard wired into the logic in the substrate 24A–D, by, for example, including a logic device on the flexible circuit 22A–D. Examples of ejector 18 sequences that may be pre-programmed into the systems 10–16 and selected by a user, using switches or other devices as described below, are as follows:

Sequence 1 a) activate ejector E1 b) activate ejector E2 c) activate ejector E3 d) repeat steps a–c

Sequence 2 a) activate ejector E1 and ejector E2 simultaneously b) pause for two microseconds c) activate ejector E2 and ejector E3 simultaneously d) pause for four microseconds e) activate ejector E3 and ejector E1 simultaneously f) pause for two microseconds e) repeat steps a–f Sequence 3 a) activate ejector E1, ejector E2, and ejector E3 simultaneously b) pause for ten microseconds c) repeat steps a–b.

The foregoing sequences 1–3 are illustrative of only a few of the many sequences that can be pre-programmed into the systems 10–16 for use of the systems for specific applications. Such applications, include, but are not limited to use of a printhead containing an ejector head assembly 20A–D for depositing a pre-coat material onto a print media just prior to ejecting ink onto the print media. Only one input would be required to activate the ejector head assembly 20A–D and the power source to the assembly would be located in the printer.

Another application of the systems 10–16 described herein is providing a sterile water device for irrigating eyes or other areas of a person's body during surgery. The sterile water device would be unsealed during surgery then disposed of without having to clean the device for reuse. In this case, the sterile water device would be self-contained including a power source or battery.

Yet another application of the systems 10–16 may be providing lubricating oil to a mechanical device such as a bearing. The system 10–16 may be programmed to spray oil on demand or on a set periodic basis. The demand spray of oil may be activated by changing conditions such as load, temperature, and the like.

Systems 10–16 as set forth herein may also be used for cleaning record/play devices. For example, ejector head assemblies 20A–D may be located adjacent recording heads of video cassette recorders (VCR) and players, digital video display (DVD) recorders and players, cassette tape recorders and players, or any other devices that require periodic cleaning. The assemblies may be used to spray cleaning fluids on the heads of the record/play devices.

Figure 5:
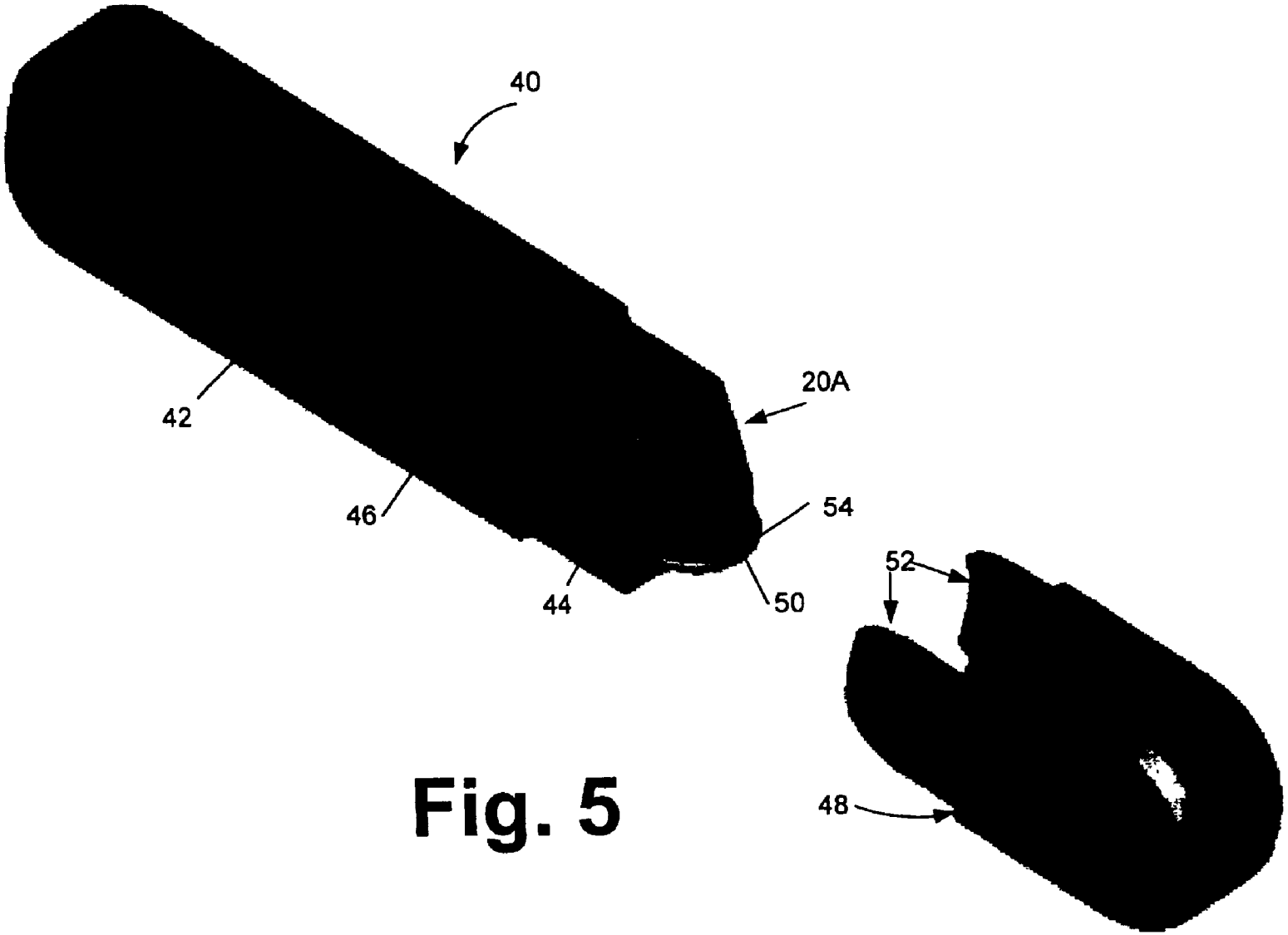
FIG. 5 is a perspective view of a hand-held device containing a micro-miniature fluid ejector assembly according to the invention.

Other uses of the systems 10–16 according to the invention include small, local fire extinguishers for electrical and mechanical equipment, on demand evaporative cooling of electronic devices and mechanical equipment, hand held ink jet printers, ink jet highlighters, ink jet air brushes, and the like. FIG. 5 is a perspective view of a hand-held ink jet printer 40 containing an ejector head assembly 20A according to the invention. The hand-held ink jet printer 40 includes an elongate body 42 for containing a power supply 28, an ink reservoir 44, and an activation button 46. The head assembly 20A is preferably fixedly attached to the ink reservoir 44 which is removably attached to the body 42 for replacement of the power supply 28 contained therein.

A protective cap 48 is provided to protect a nozzle plate 50 on the head assembly 20A. The cap 48 also preferably includes projections 52 for covering the activation button 46 when the cap 48 is in place over the head assembly 20A. A shoulder 54 is preferably provided on the head assembly 20A to prevent the nozzle plate 50 from directly contacting print media and to assure that the nozzle plate 50, which typically forms part of the fluid ejectors 18, is at the optimum distance from the print media during use.

Figure 6:
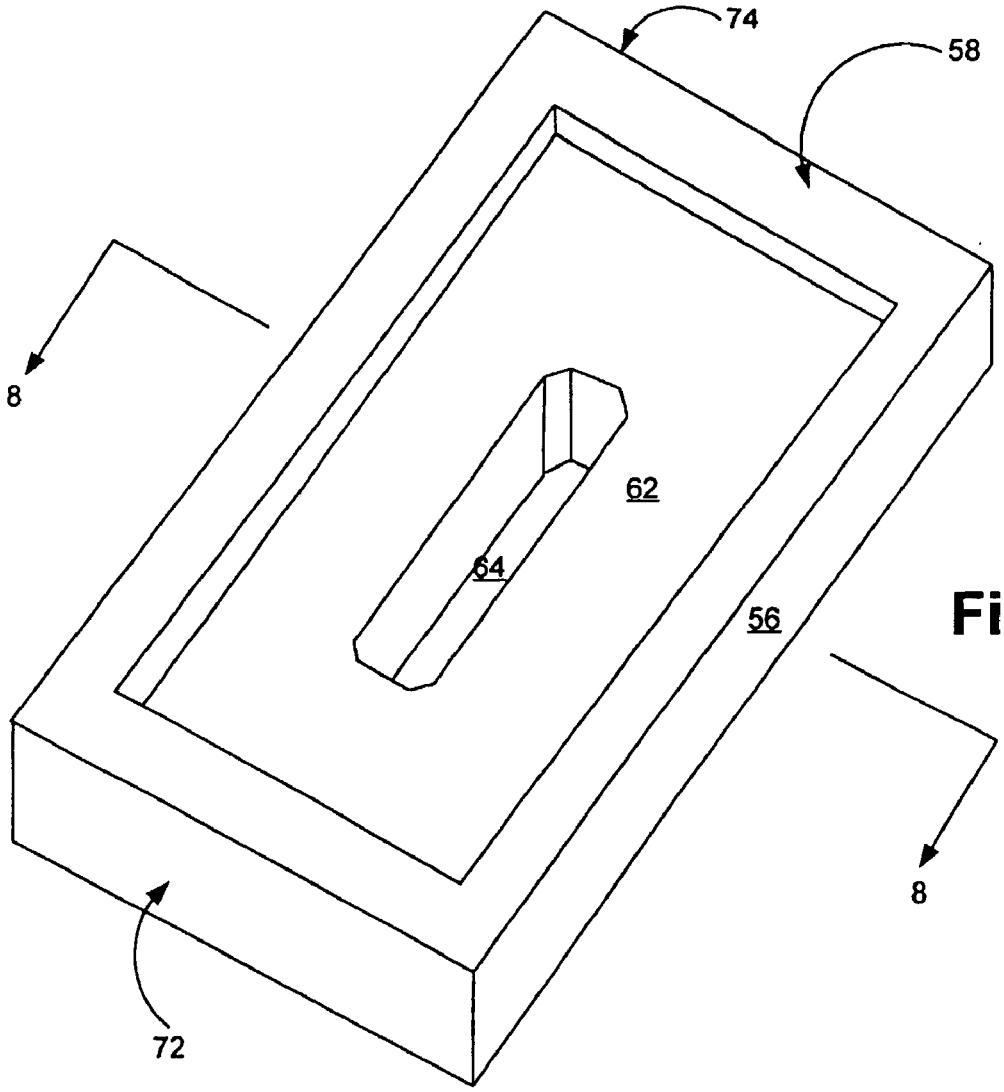
FIGS. 6 and 7 are perspective and side views, not to scale, of a head box for use with ejector head assemblies according to the invention.
Figure 7:
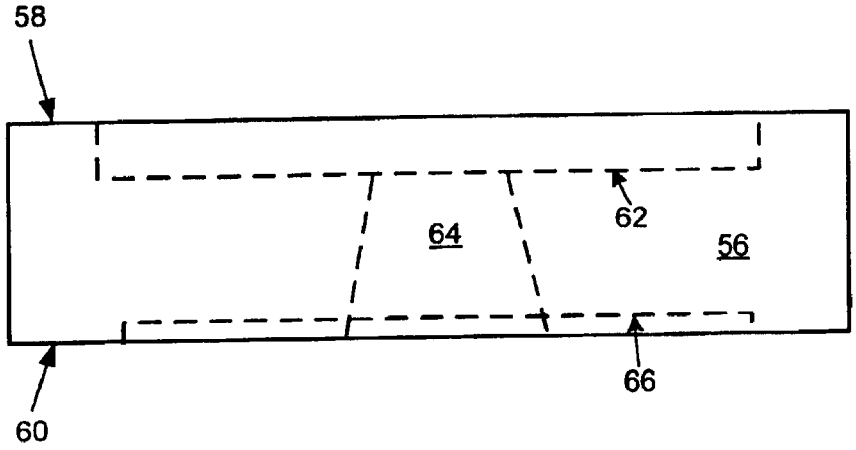

Aspects of components of the head assembly 20A are illustrated in FIGS. 6–10. FIG. 6 is a perspective view of a head box 56 for an ejector head assembly 20A. The jet head box 56 has a first surface 58 and a second surface 60 (FIG. 7) opposite the first surface 58. A first recessed area is provided in the first surface 58 of the head box 56 defining a substrate pocket area 62. An elongate fluid slot 64 is preferably formed in the head box 56 extending from the second surface 60 to the first surface 58 thereof.

For some applications, the head box 56 may contain two, three, or four elongate fluid slots such as slot 64 for ejecting two, three, or four different fluids, such as different colored inks toward a print media. Cross-sectional views of the head box 56 are provided FIGS. 7 and 8 for an ejector head box 56 containing a single elongate slot 64.

The head box 56 may be fabricated from a wide variety of non-conductive materials, including, but not limited to, ceramics, plastics, wood, plastic coated metal, and the like. A preferred material for the head box 56 is a standard material for a surface mounted integrated circuit (IC) package such as a high softening point thermoplastic material. The head box 56 may be molded or machined to provide the features thereof such as the substrate pocket area 62, elongate fluid slot 64, and the like.

In keeping with the desire to provide a low cost micro-miniature fluid jetting device, the overall size of the ejector head box 56 is relatively small. Preferably, the overall dimensions of the head box 56 are from about 6 to about 12 millimeters in length, from about 3 to about 7 millimeters in width, and from about 2 to about 4 millimeters in thickness. The semiconductor chip 24A–D attached in the substrate pocket area 62 of the head box 56 preferably has a length ranging from about 3 to about 8 millimeters in length, from about 0.9 to about 2.9 millimeters in width, and from about 0.5 to about 1.0 millimeters in thickness. A nozzle plate 50 having similar dimensions to that of the semiconductor substrate 24A–D is preferably attached to the substrate 24A–D. Accordingly, the depth of the substrate pocket area 62 preferably ranges from about 1.0 to about 2.0 millimeters in depth. The dimensions of the fluid slot 64 in the head box 56 are not critical to the invention provided the fluid slot 64 provides a sufficient opening for flow of fluid to the semiconductor substrate. Preferred dimensions of the fluid slot 64 range from about 4.5 to about 5.5 millimeters in length and from about 1.0 to about 1.5 millimeters in width.

The second surface 60 of the head box 56 (FIG. 7) may contain a second recessed portion defining a filter pocket area 66. It is preferred that a filter 68 (FIG. 8) be attached in the filter pocket area 66 on the second surface 60 of the head box 56 before the head box 56 leaves a clean room area where the semiconductor substrate 24A–D is attached to the head box 56. In an alternative design, a filter may be attached to the semiconductor substrate 24A–D between the substrate 24A–D and the first surface 58 of the head box 56, or a filter may be integrated into the nozzle plate 50 between the substrate 24A–D and nozzle plate 50. A nozzle plate 50 containing an integrated filter is described, for example, in U.S. Pat. No. 6,045,214 to Murthy et al. entitled "Ink jet printer nozzle plate having improved flow feature design and method of making nozzle plates," the disclosure of which is incorporated by reference as if fully set forth herein.

Figure 8:
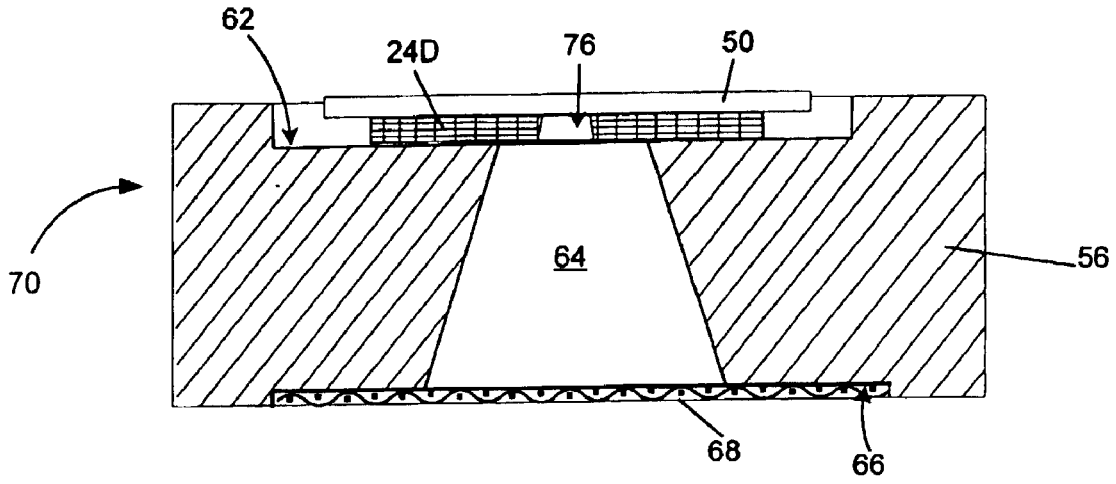
FIG. 8 is a cross-sectional view, not to scale, of a micro-miniature fluid ejector head assembly according to the invention.
Figure 9:
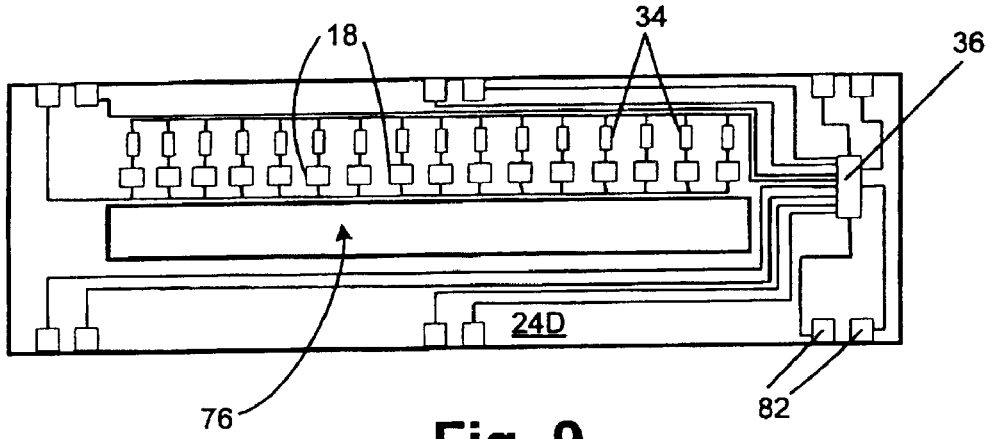
FIG. 9 is a plan view, not to scale of a semiconductor substrate for use with a micro-miniature fluid ejector device according to the invention.

FIG. 6 is a cross-sectional view, not to scale of an assembled micro-miniature jetting device 70 for an ejector head assembly 20D containing the ejector head box 56, filter 68, semiconductor substrate 24D, and nozzle plate 50 viewed toward an end 72 opposite end 74 of the ejector head box 56 (FIG. 6). As seen in FIGS. 8 and 9, the substrate 24D includes a fluid via 76 therein for feeding fluid to the substrate 24D. It is preferred that the fluid ejectors 18 be disposed only on one side of the fluid via 76 as shown in FIG. 9.

Figure 10:
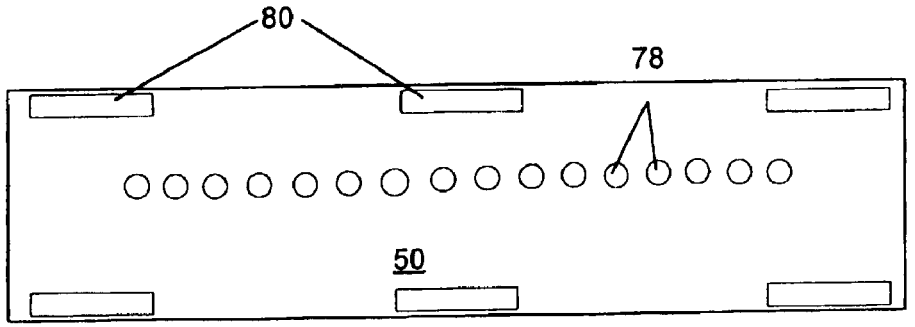
FIG. 10 is a plan view, not to scale, of a nozzle plate for use with a micro-miniature fluid ejector device according to the invention.

FIG. 10 illustrates a nozzle plate 50 containing nozzle holes corresponding to the fluid ejectors 18. Windows 80 are preferably provided in the nozzle plate 50 for access to the contacts 82 on the substrate 24D for electrically connecting a flexible circuit 22D thereto. The nozzle plate 50 and substrate 24D are preferably made using conventional ink jet fabrication technology.

Figure 11:
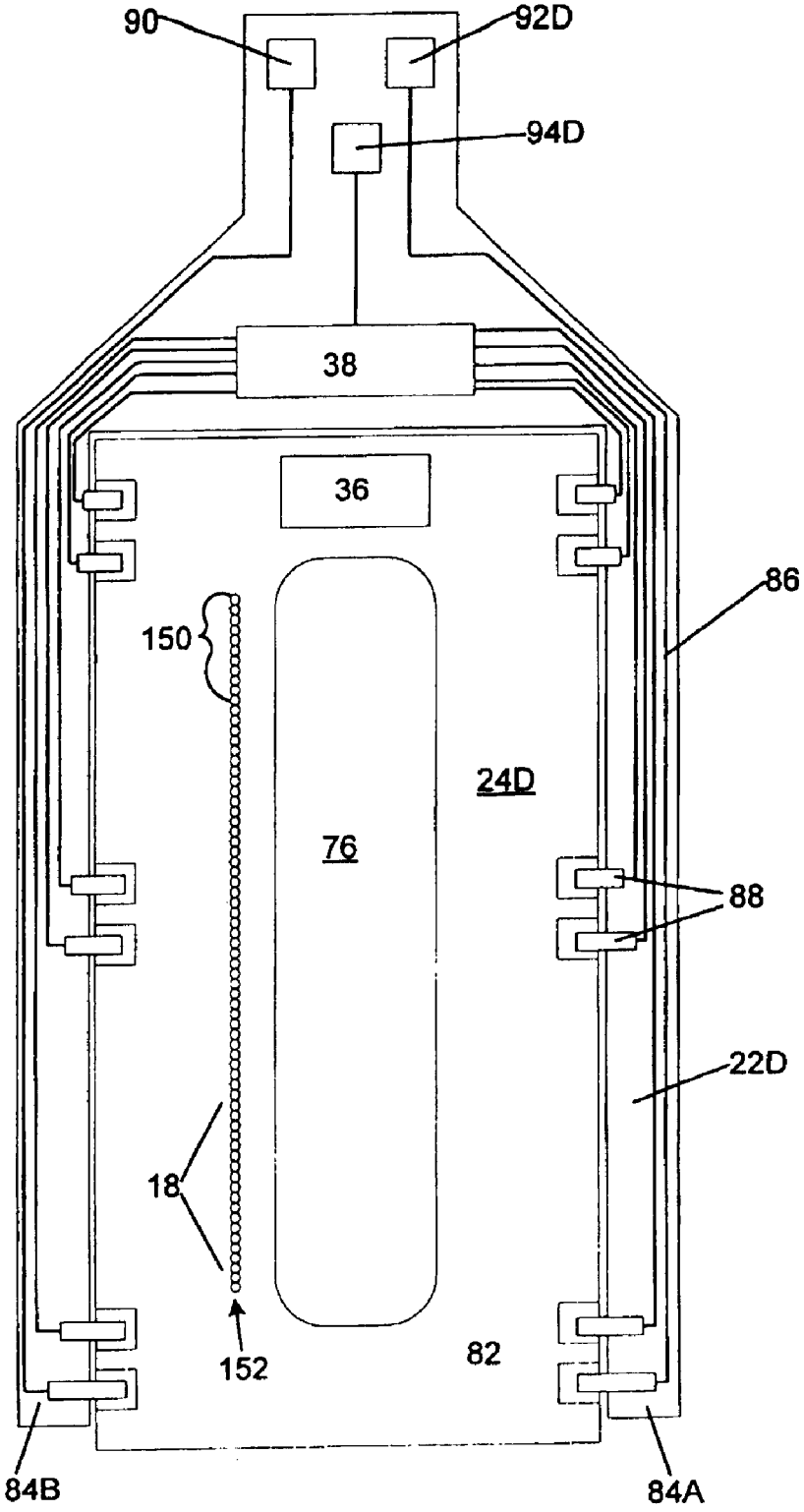
FIG. 11 is a plan view, not to scale, of a semiconductor substrate and flexible circuit attached thereto for a micro-miniature fluid ejector device according to the invention.
Figure 12:
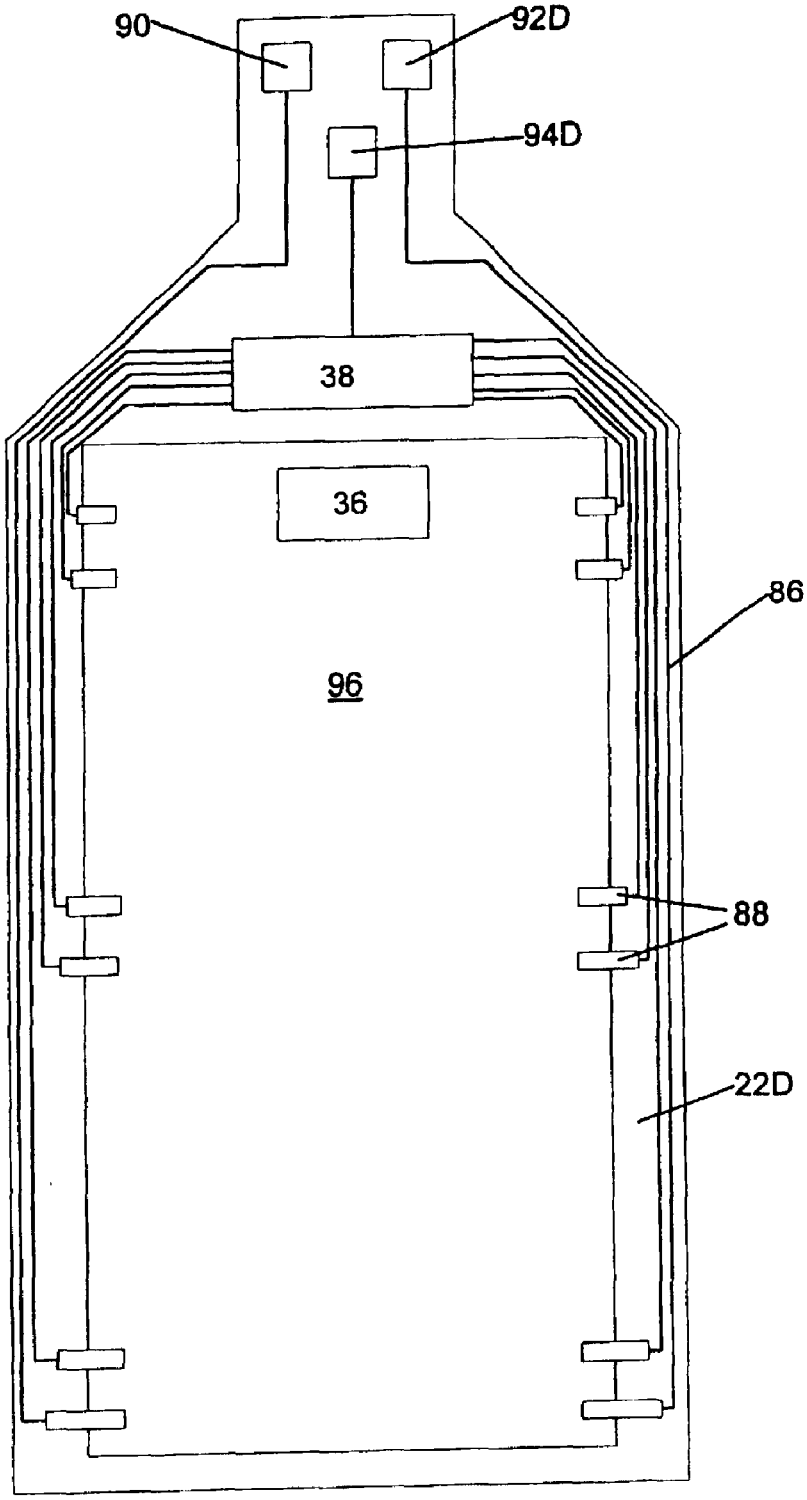
FIG. 12 is a plan view, not to scale, of an alternative flexible circuit for a micro-miniature fluid ejector device according to the invention.

FIG. 11 is an illustration of a typical assembled flexible circuit 22D to a substrate 24D. The flexible circuit 22D may contain two elongate strips 84A and 84B having traces 86 and contacts 88 thereon for electrical connection to the substrate 24D using wire bonding or TAB bonding techniques. An important feature of the invention is that the flexible circuit 22D only contains two or three contacts, such as contacts 90, 92, and 94 which are non-permanently connected to power supply 30 and/or user input 32 sources in a micro-miniature jetting device. In an alternative embodiment, the flexible circuit 22D may contain a window or opening 96 therein as shown in FIG. 12 rather than elongate strips 84A and 84B for attaching the substrate 24D to the flexible circuit 22D.

Figure 13:
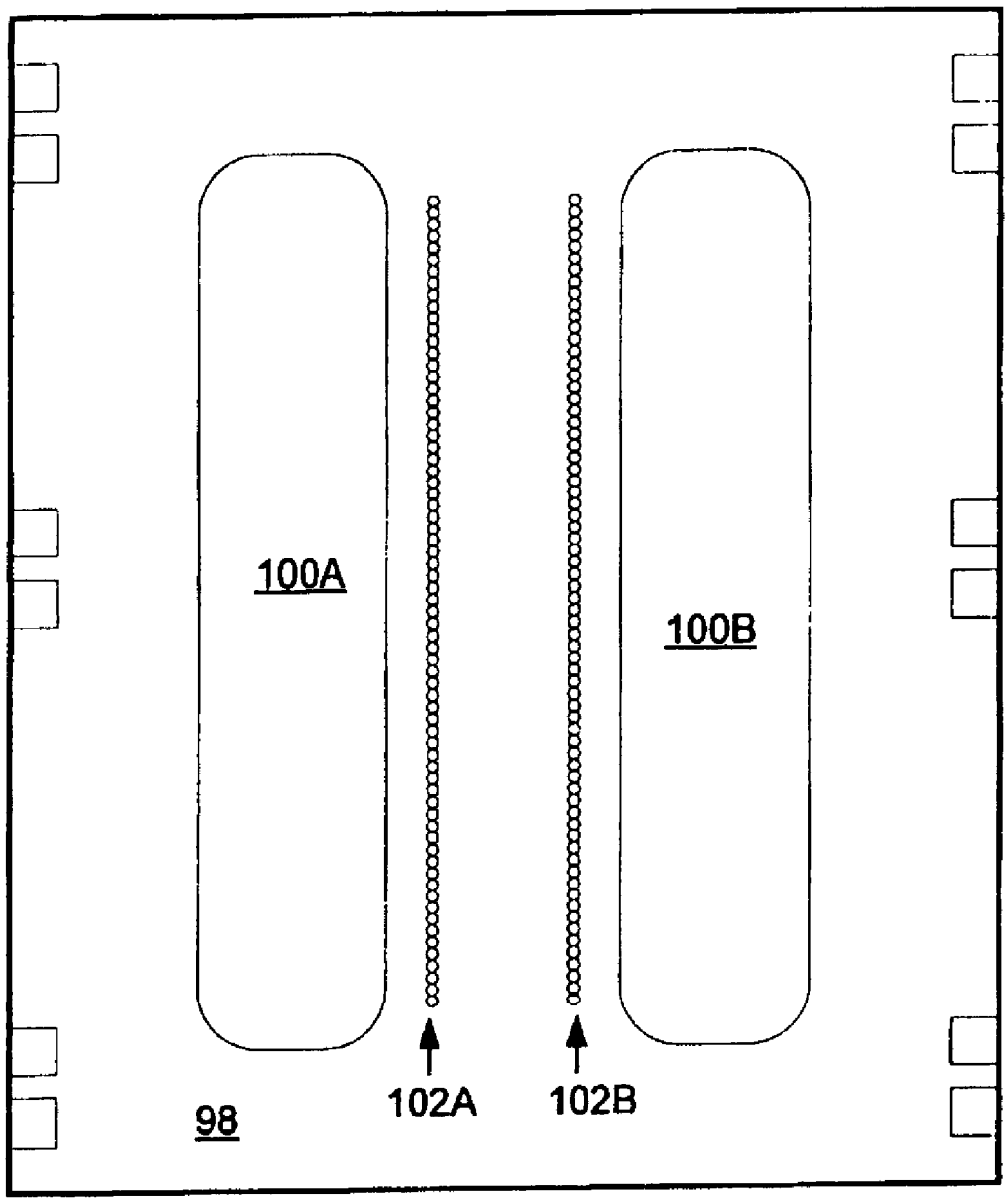
FIG. 13 is a plan view, not to scale, of an alternative semiconductor substrate for a micro-miniature fluid ejector device according to the invention.

As with the jet head box 56 as described above, the substrate may contain more than one fluid via therein for ejecting more than one fluid, or in the case of ink ejection, more than one color ink. FIG. 13 illustrates a substrate 98 containing two fluid vias 100A and 100B. Adjacent one side of the fluid vias 100A and 100B are arrays of fluid ejectors 102A and 102B respectively. As described in more detail below, each array of ejectors 102A and 102B may be programmed separately to provide different patterns of ink on a print media, in the case of ink ejection. Thus one array of ejectors such as 102A may be programmed to eject one color ink from all nozzles all of the time and the other array of ejectors 102B may be programmed to eject large ink droplets or to eject ink at a much lower frequency than the ejectors 102A in the first array. Locating the ejector arrays 102A and 102B toward the center of the substrate 98 between the two fluid vias 100A and 100B enables closer spacing between the arrays of ejectors 102A and 102B for more precise ejection of fluid to a selected target.

Figure 14:
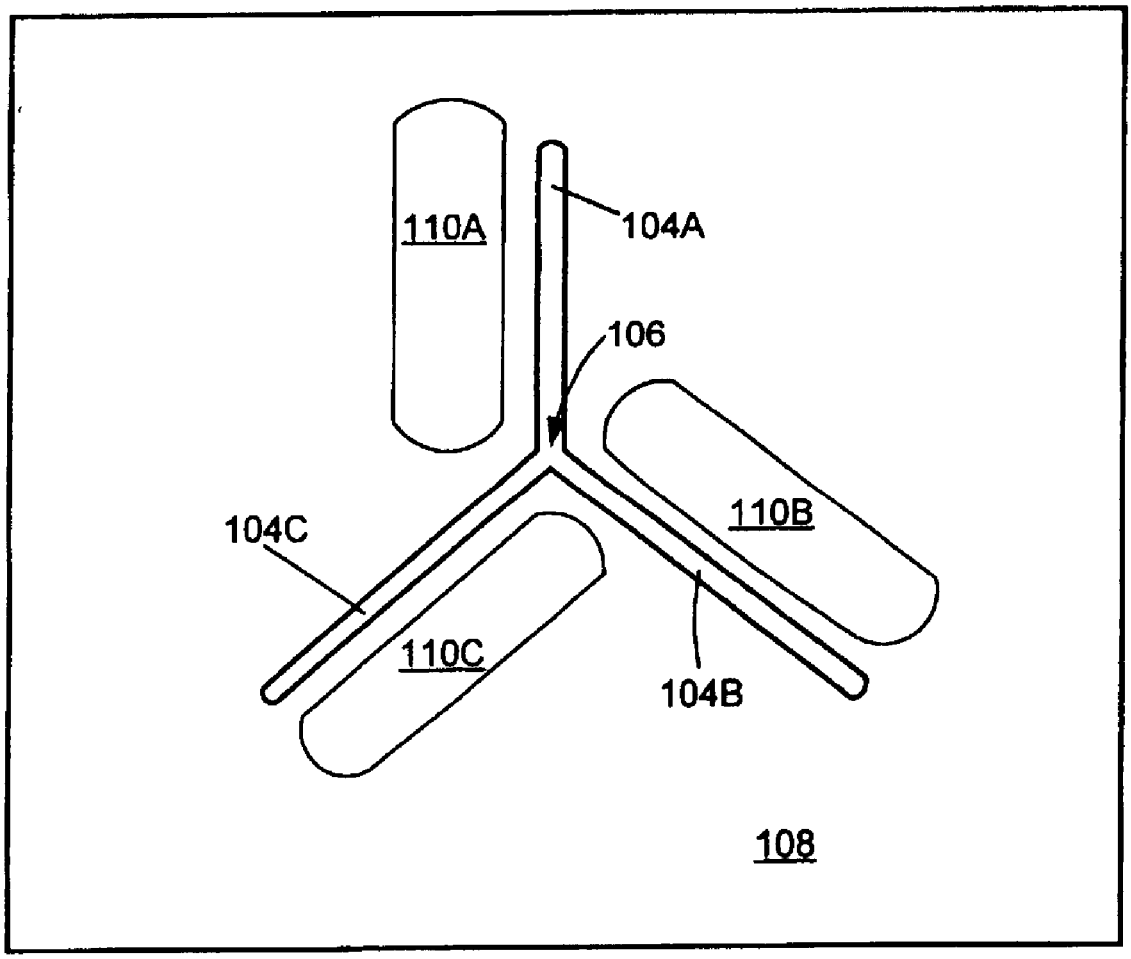
FIG. 14. is a plan view, not to scale, of another alternative semiconductor substrate for a micro-miniature fluid ejector device according to the invention.
Figure 15:
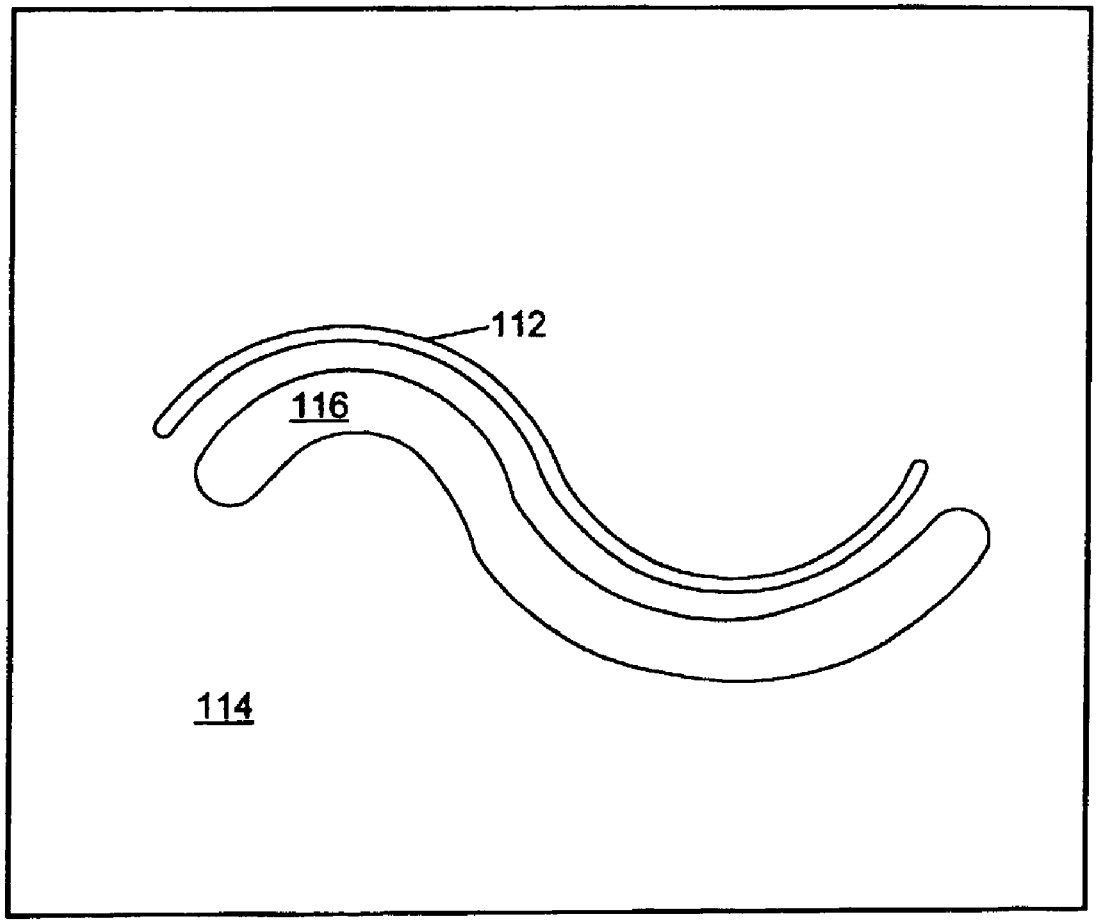
FIG. 15. is a plan view, not to scale, of yet another alternative semiconductor substrate for a micro-miniature fluid ejector device according to the invention.
Figure 16:
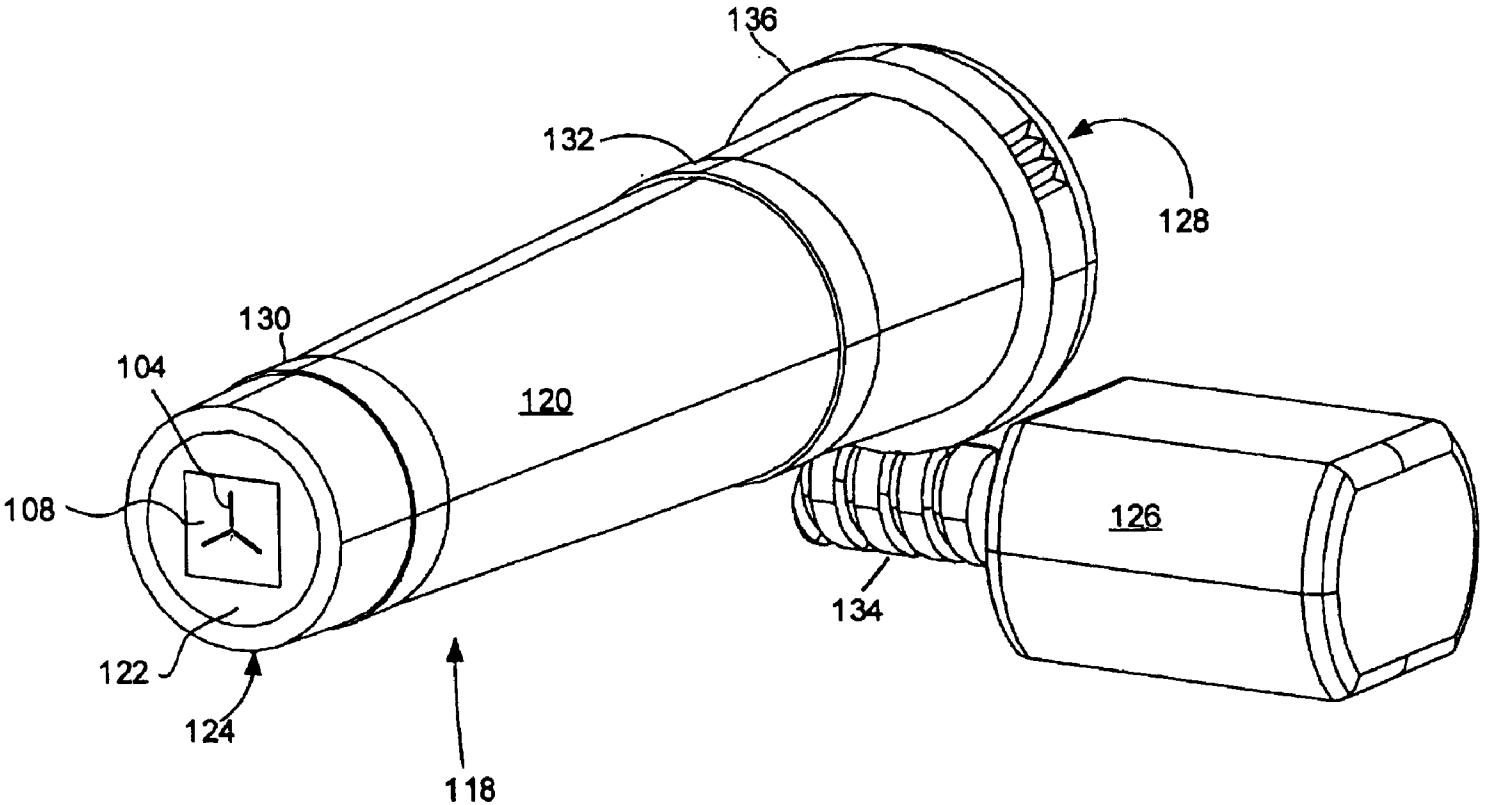
FIGS. 16–19 are a perspective views, not to scale, of portions of a hand held rotating device containing a micro-miniature fluid ejector device according to the invention.

In the foregoing embodiments described above, the substantially linear arrays of ejectors 18, 102A and 102B are described. However, the invention is not limited to linear arrays of ejectors. FIGS. 14 and 15 illustrate other arrangements of ejectors arrays according to the invention. For example, in FIG. 14, three arrays of ejectors 104A–104C are radiating linearly from a single point 106 on the substrate 108. Accordingly, one or more fluid vias, such as fluid vias 110A–110C are provided to provide fluid to the respective arrays of ejectors 104A–104C. In FIG. 15, a curved array of ejectors 112 is provided on a substrate 114. Likewise, a curved fluid via 116 is provided to supply fluid to the curved array of ejectors 112. Other arrangements of fluid ejectors 18 according to the invention may include, but are not limited to, a two-dimensional grid array of fluid ejectors 18.

The foregoing radiating array of ejectors illustrated in FIG. 14 and/or the curved array of ejectors illustrated in FIG. 15 may be used, for example, in a rotating ink jet printing system 118 as illustrated in FIGS. 16–19 to provide circle images or other designs. The system 118 includes a rotating body portion 120 having a jet head box 122 on one end 124 thereof. The jet head box 122 includes substrate 108 or 114 as described above. A drive 126 is provided, preferably adjacent an opposing end 128 of the rotating body portion 120. The rotating body portion 120 and drive 126, are preferably enclosed in a housing (not shown) or otherwise supported in a fixed position relative to each other. Bearing surfaces 130 and 132 are preferably provided on the rotating body portion 120 for maintaining the body portion 120 in a fixed position for printing. The drive 126 may be directly connected to the rotating body portion 120 or may be use pulleys and/or gears to rotate the body portion 120. A worm gear 134 is preferably used to rotate the body portion 120 during use of the system 118. The worm gear 134 preferably intermeshes with gear teeth 136 adjacent end 128 of the body portion 120.

Figure 17:
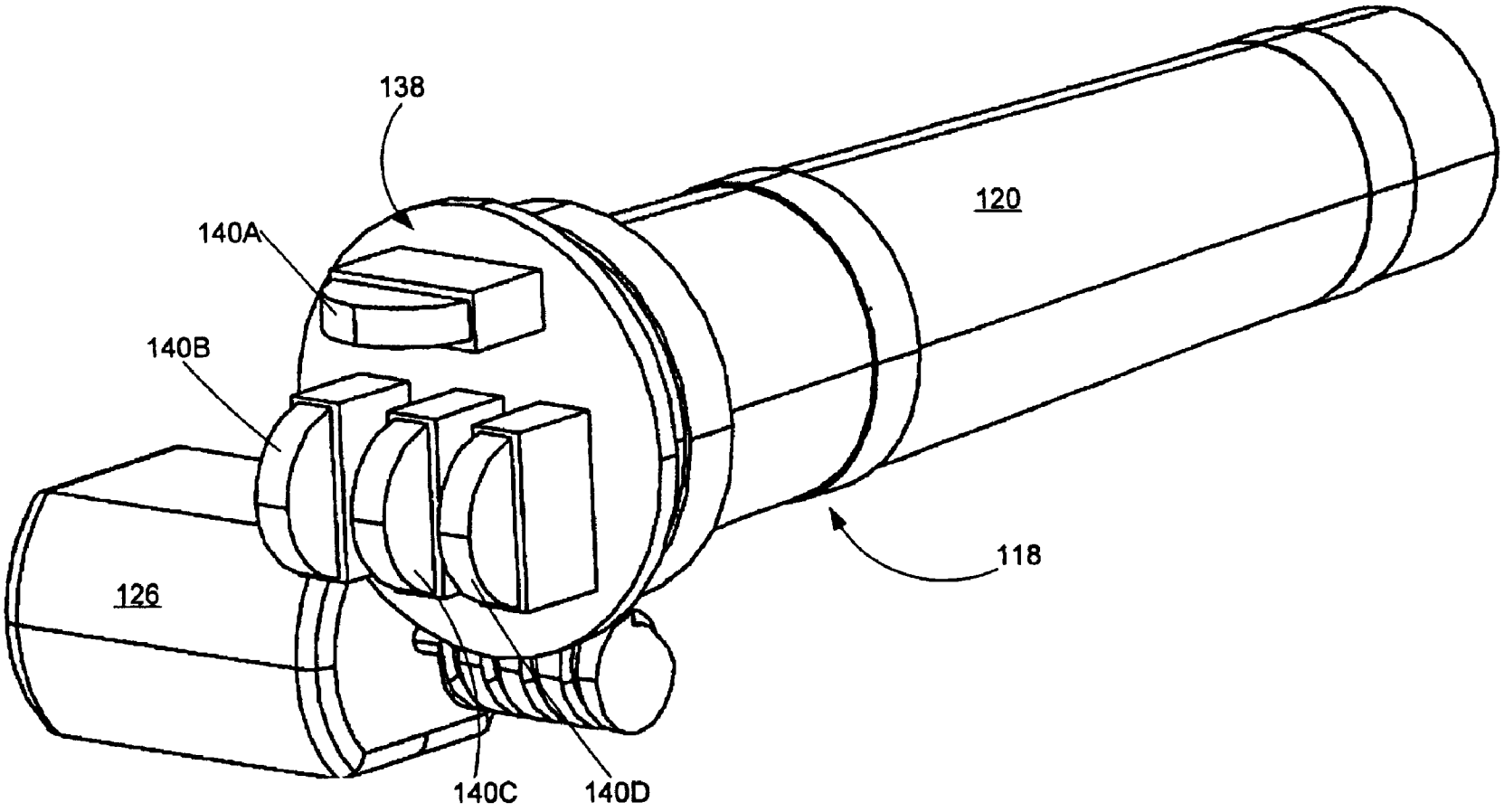
Figure 18:
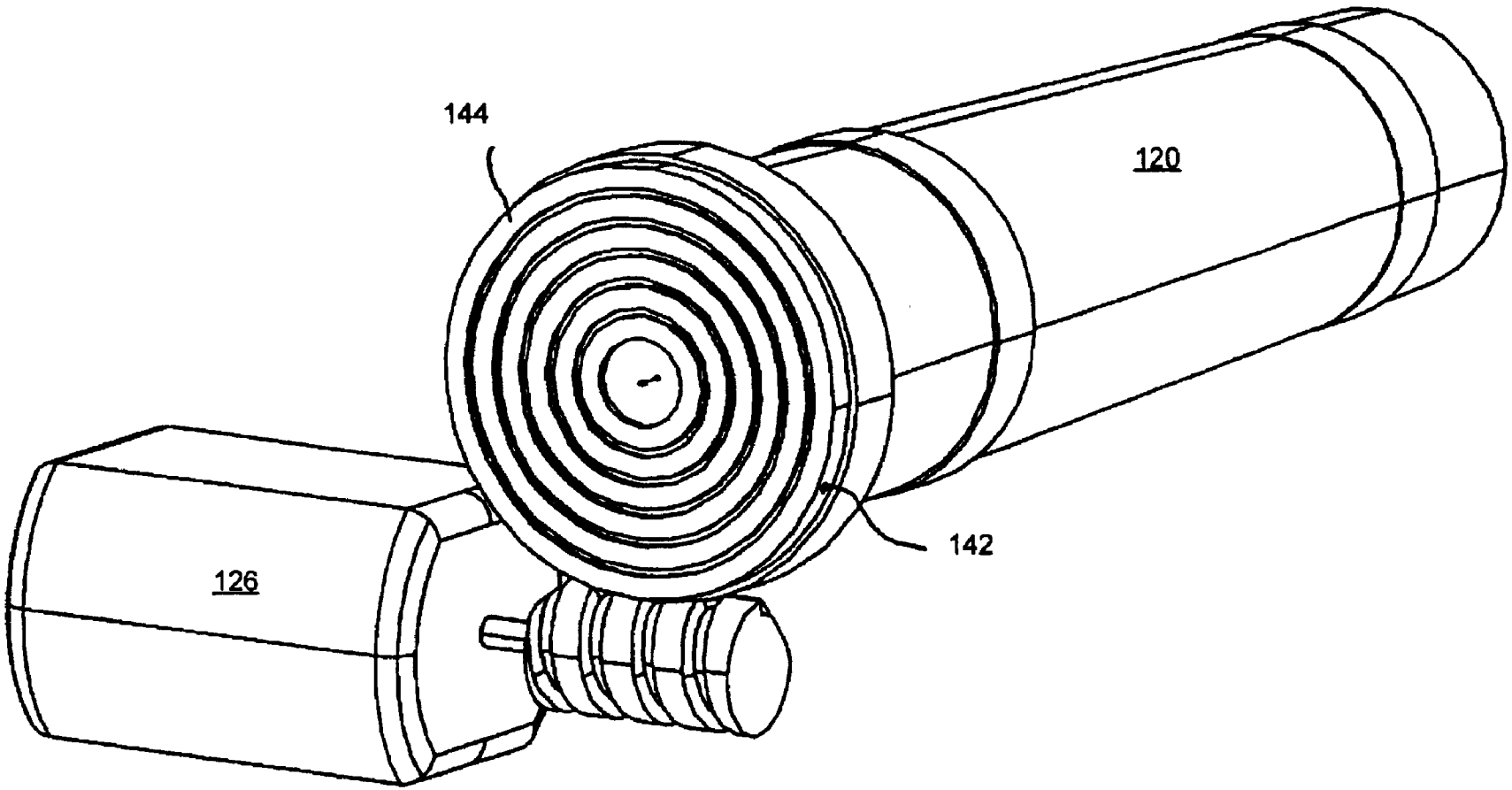
Figure 19:
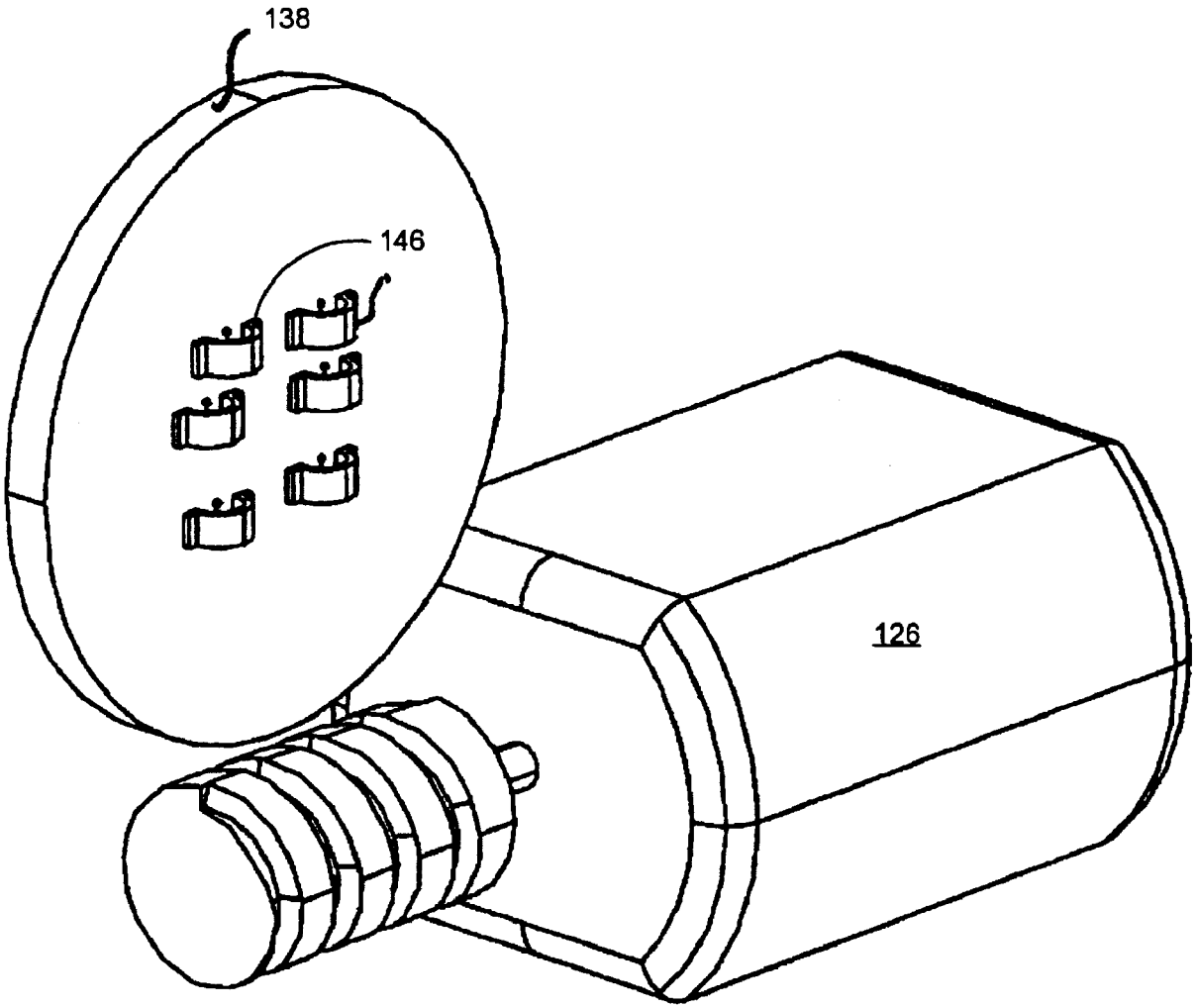

In order to provide power and user inputs to the rotating ink jet printing system 118, end 128 of the body portion preferably contains a stationary plate or printed circuit board 138 containing potentiometers 140A–140D, switches, or other user input devices for manual control of the system 118 as shown in FIG. 17. Potentiometers 140A–140D may be used to set the ratio of three different ink colors ejected by the ejectors 104A–C, and/or the overall flow rate of ink from the ejectors 104A–C. Rotation of the body portion 120 may be used to mix colors of inks as they are ejected or to produce round image dots on a media. A rotational speed of about 10 revolutions per minute is preferable.

The stationary plate or printed circuit board 138 preferably does not rotate with the body portion 120 of the system. Sliding contacts are provided on the back of the stationary plate or printed circuit board 138 for contact with a rotating contact plate 142 (FIG. 18) attached to the rotating body portion 120. Circular conductors 144 are provided on a surface of the rotating contact plate 142 for contact with the sliding contacts on the back of the stationary plate or printed circuit board 138. Spring contacts 146 (FIG. 19) are provided on a surface of the rotating contact plate 142 opposite the surface containing conductors 144 for mating contact with conductors attached to the substrate 108 for operation of ejectors 104A–C on the substrate 108.

Another important aspect of the invention is the provision of control schemes for a micro-miniature fluid ejectors system 10–16 which provide firing of the ejectors 18 substantially automatically in a random or sequential fashion. Firing the ejectors 18 substantially automatically means that selection of individual ejectors is provided by logic devices contained on the substrate 24A–D, or on the flexible circuit 22A–D, or on the substrate 24A–D and on the flexible circuit 22A–D with only limited input by a user. For example, an enable line may be provided as a contact 94 on the flexible circuit 22A–D (FIG. 12). Voltage waveforms for the input to the enable line contact may be generated by simple components such as switches, resistors, voltages sources and the like.

In the simplest form, a switch may be used to select only a portion 150 of ejectors 18 from an array 152 of ejectors to fire in one mode, and all of the ejectors 18 in the array 152 may be fired in another mode (FIG. 11). A slider bar, multiple contact switch, or potentiometer may be used to select different groups of ejectors 18 for firing to produce different fluid line widths or other fluid patterns. However, each ejector 18 selected will fire at a predetermined rate regardless of how many ejectors 18 are selected to fire at a time. Accordingly, digital logic inputs to the system are not required. Idle ejectors 18 may be automatically programmed to jet after a predetermined delay time to prevent clogging of nozzle holes 78.

Illustrative examples of electronic components for operation of micro-miniature fluid ejector systems 10–16 according to the invention will now be described. At a minimum, each system 10–16 includes a driver 24A–D for activating the ejectors 18 and a sequencer 36 for selecting which ejector or group of ejectors 18 is activated for a given application. As will be recognized by those skilled in the art, the ejectors 18 may be any type of micro-miniature fluid motive devices such as heater resistors, piezoelectric devices and the like. The type of fluid motive device used in the systems 10–16 of the invention is therefore not critical to the invention.

Figure 20:
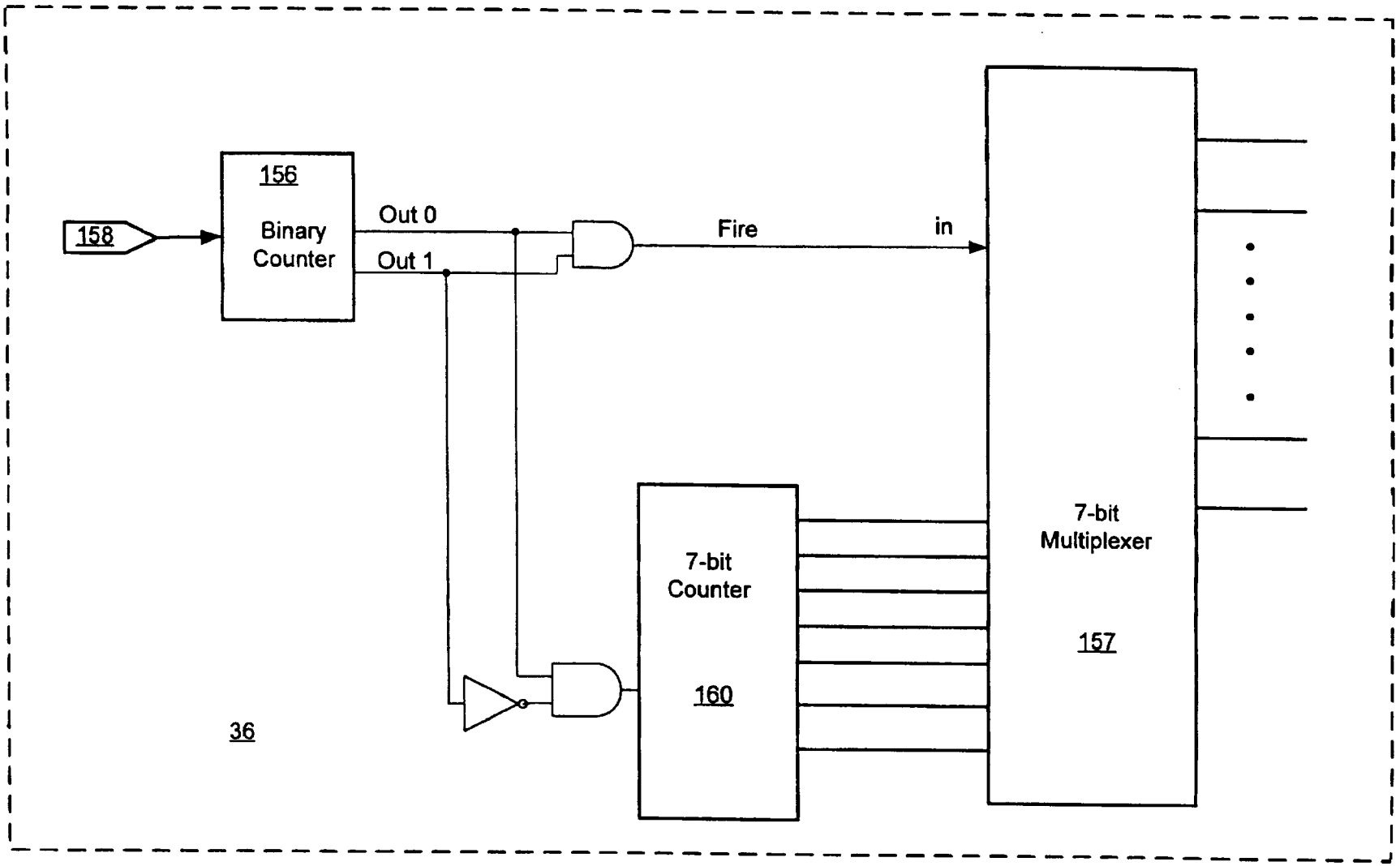
FIGS. 20–24 are schematic representations of various circuit configurations for use with a micro-miniature fluid ejector device according to the invention.
Figure 23:
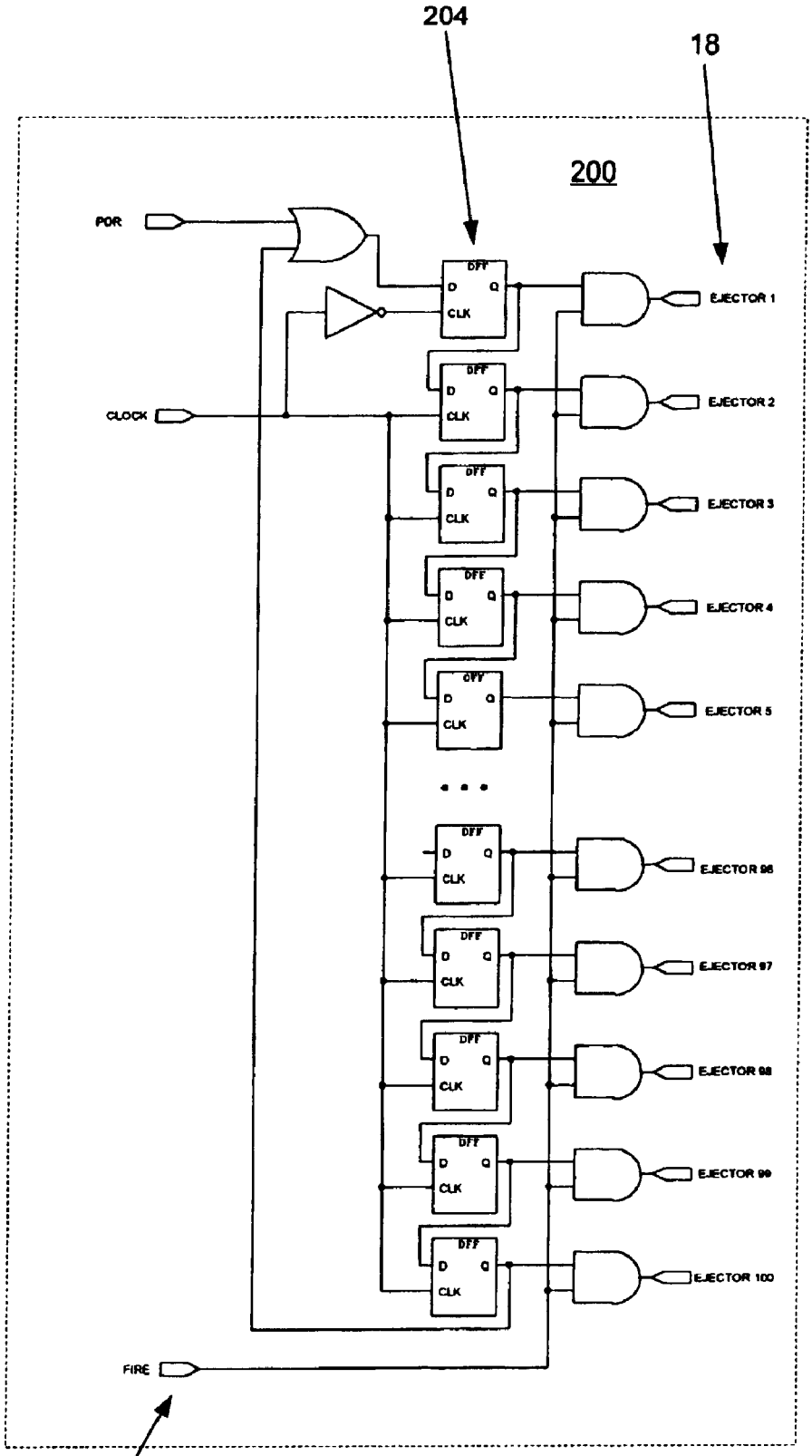
Figure 24:
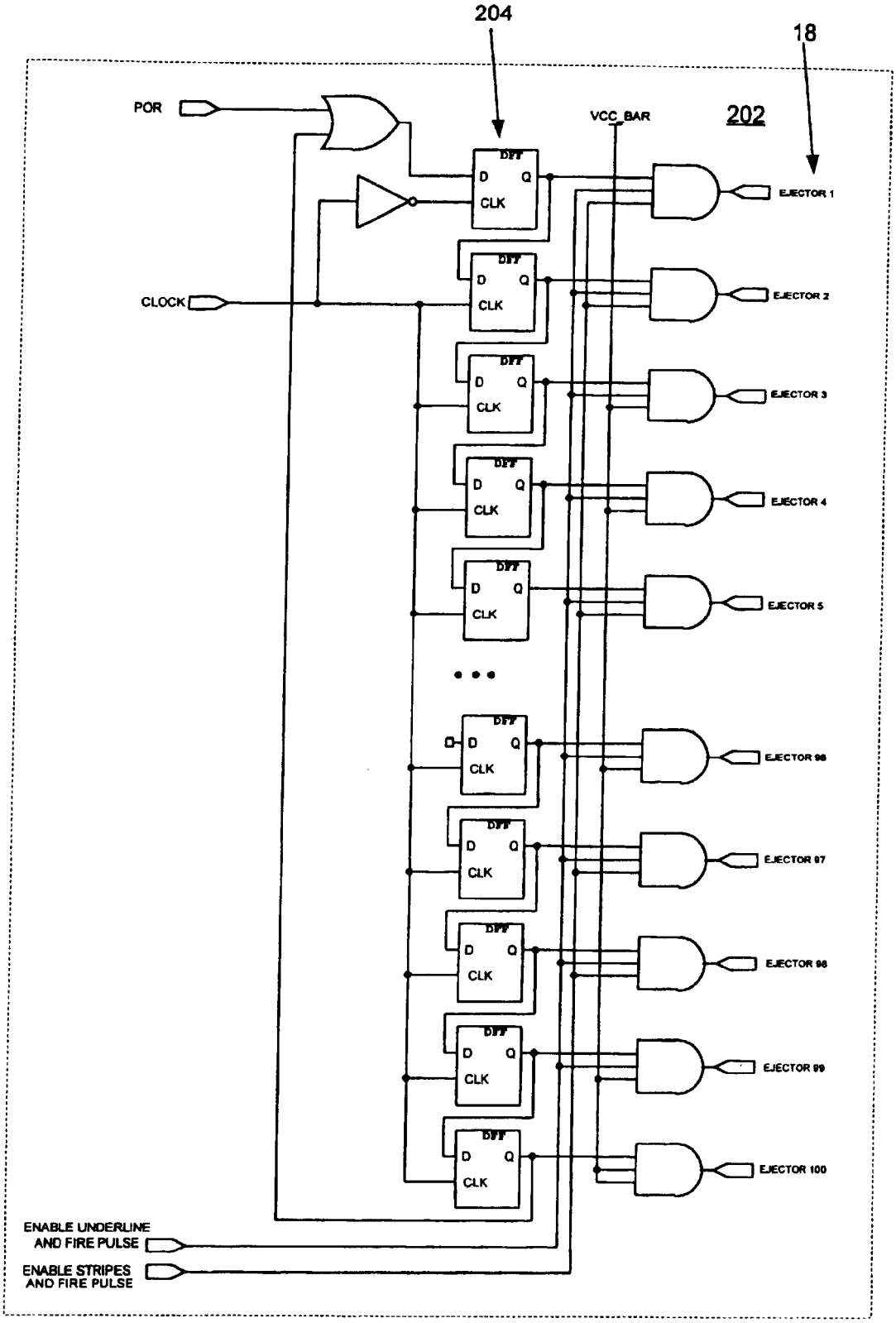

Representative ejector sequencers 36 that may be used are illustrated in FIGS. 20, 23 and 24. The sequencer 36 illustrated in FIG. 20 includes a binary counter 156 having a clock signal input 158 from a clocking circuit described below. The clock signal input 158 is preferably a 660 KHz clock signal input. The binary counter 156 may provide a fire pulse to a seven-bit multiplexer 157 for activation of individual ejectors 18.

Figure 21:
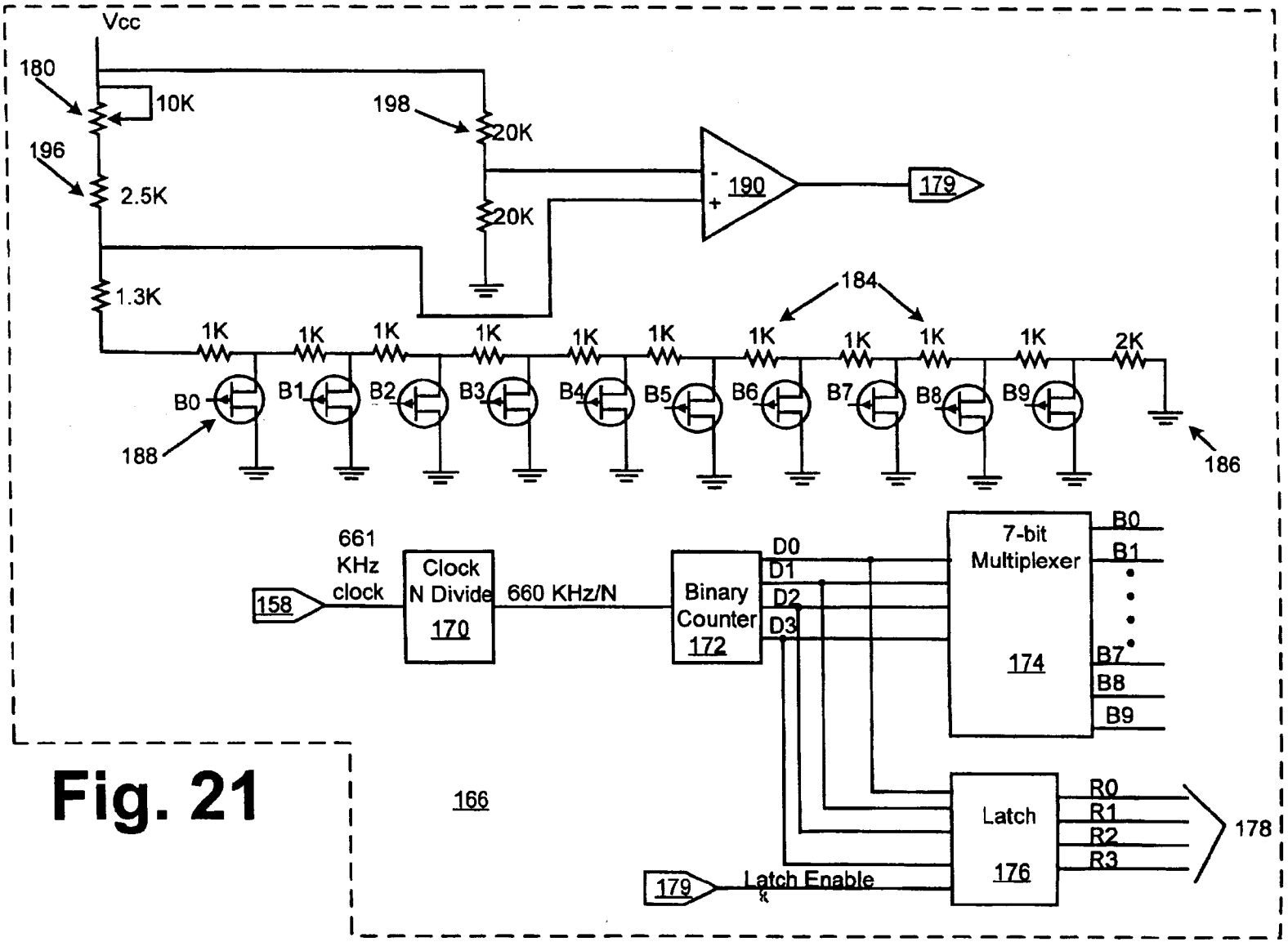
Figure 22:
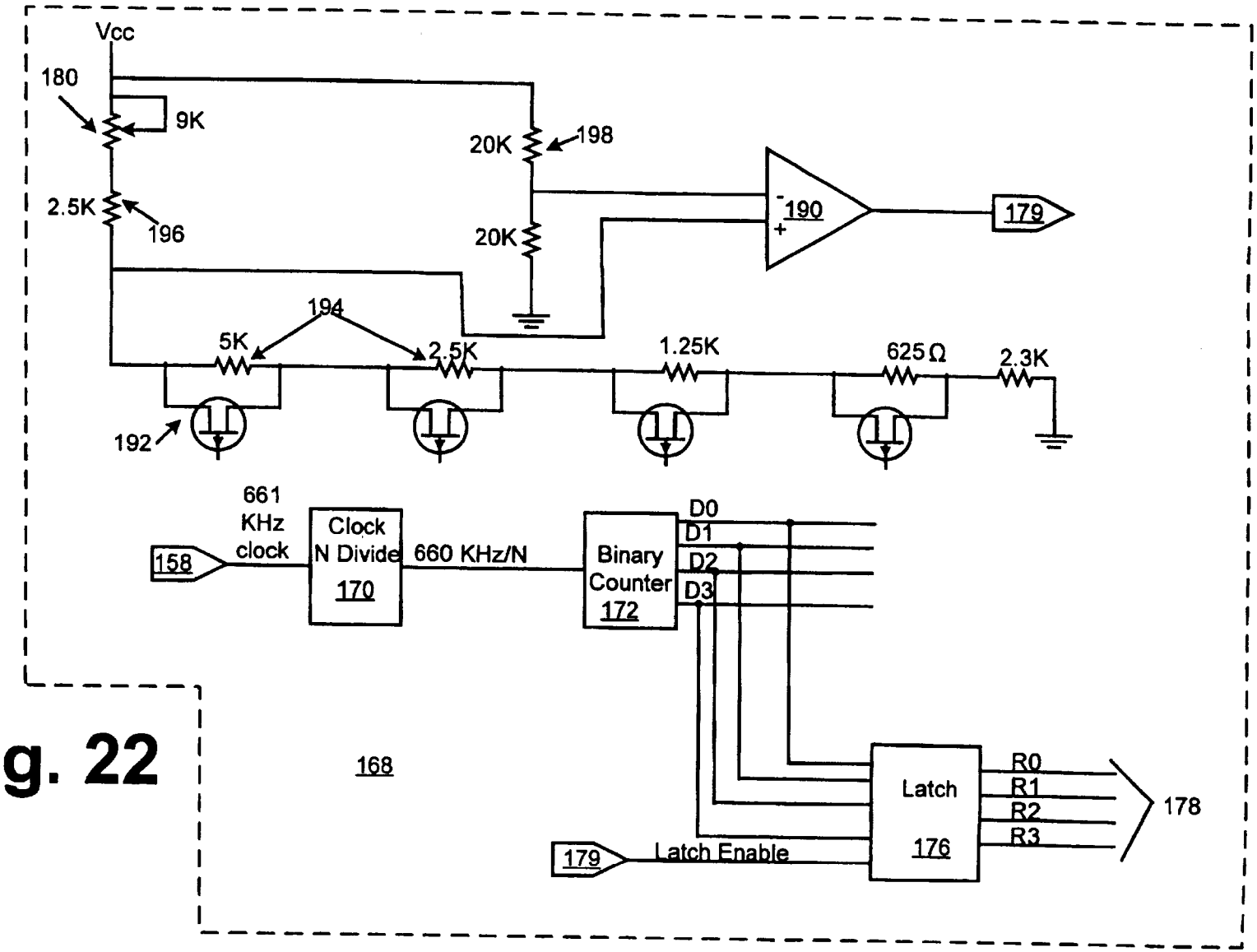

If a variable resistance input, such as by use of a potentiometer, is provided as a user control input 32 (FIGS. 1–4), analog to digital (ADC) circuits 166 and 168 as provided in FIGS. 21 and 22 may be used in conjunction with the ejector sequencer 36 to control the ejector devices 18. In FIG. 21, a clock signal input 158 from the clocking circuit provides a 660 KHz clock signal input to a clock signal N divider 170. The output from the clock signal N divider 170 is input to a binary counter 172. Outputs from the binary counter 172 are provided to a multiplexer 174. The counter increments every N/660,000 seconds with N being chosen based on the maximum speed of the comparator.

The multiplexer 174 selects one of a series of field effect transistors (FET's) 188 connected to a chain of resistors 188, such as 1 K ohm resistors, so that selected sections of the chain of resistors 184 may be grounded. A comparator 190 will go high when the resistor chain 184, up to the first active FET 188, is greater than the resistance of the potentiometer 180. The rising edge of the comparator 190 output triggers the latch enable digital output 179 which provides the number of the currently active FET 188. The digital value output 178 may be used to determine which ejector or group of ejectors 18 are fired for a particular application.

FIG. 22 provides another ADC circuit 168 for providing digital output 178 for activating an ejector or group of ejectors 18. In this circuit 168, a multiplexer is not required and the FET's 192 are not connected to ground. This circuit 168 is similar to circuit 166 with the exception that the comparator 190 will go high when the resistance of a series 194 of resistors and their parallel FET's 192 is greater than the value of the potentiometer 180. In this case, the resistors in the series 194 have different values ranging from 625 ohms to five K ohms. The outputs D0–D3 from binary counter 172 drive the FET's 192 unlike the multiplexer 174 in ADC circuit 166.

In both ADC circuits 166 and 168, the 2.5 K ohm and 20 K ohm resistors 196 and 198 are preferably made of the same low tolerance material such as tantalum/aluminum (TaAl). The other resistors in chains 184 and 194 may be made of a higher tolerance material such as N+. If all of the N+ resistors on a single substrate drift by the same amount, the drift is not likely to cause an error in the analog to digital conversion.

Figure 25:
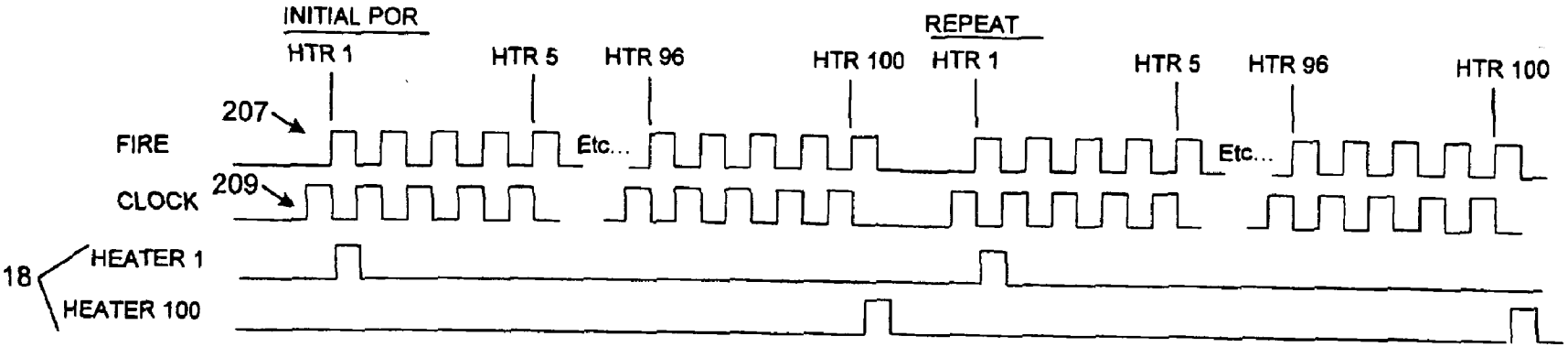
FIG. 25 is a timing sequence for a micro-miniature fluid ejector device according to the invention.

In FIGS. 23 and 24, the sequencer circuits 200 and 202 are provided by N-bit shift registers 204 for N number of ejectors 18. Each of the N-bit shift registers 204 is fed back to itself. In FIG. 23, the register for ejector 1 goes high at power on reset (POR). Next an internal clock in each of the shift registers 204 begins to shift and moves the high bit through the registers 204. The high data bit is then fed back to the beginning of the shift registers 204 and the sequence is repeated. The fire pulse from fire pulse input 206 activates whichever ejector has a latched bit at the time the fire pulse is turned on. The timing of the fire pulses 207, delay pulses 209 for fluid ejectors 18 numbered 1 and 100 are illustrated, for example, in FIG. 25.

Sequencer circuit 202, illustrated in FIG. 24 includes additional user inputs to provide variable activation of ejectors 18. For example, a battery power input/output (I/O) 208 can be provided to select one or more groups of ejectors 18 for activation to produce, in the case of an ink jet printer, underline or stripes.

Figure 26:
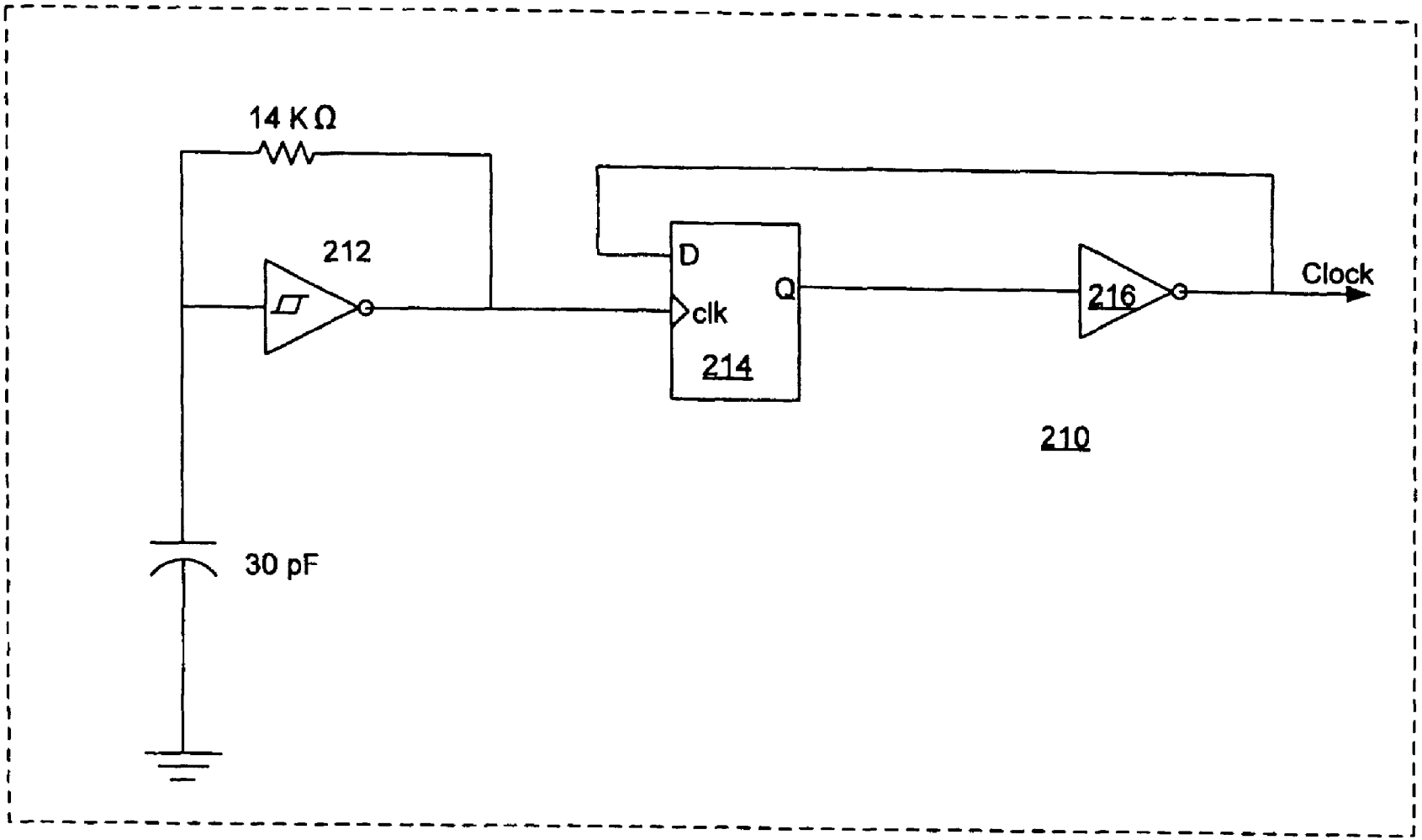
FIG. 26 is a schematic representation of another circuit configuration for use with a micro-miniature fluid ejector device according to the invention.

A preferred oscillator circuit 210 for a clock signal input to a sequencer as described above is illustrated in FIG. 26. The circuit includes an inverter 212 with hysterisis, a shift register 214, such as a D flip-flop with an edge triggered clock and a second inverter 216. The foregoing circuit 210 provides a clock signal of about 667 KHz with about a 50% duty cycle.

Other ejector activation sequences may be provided by including CMOS logic on the semiconductor substrate 24A–D or flexible circuit 22A–D. For example, a table 100 bits by n columns can be built into a read only memory (ROM) on the substrate 24A–D. The logic device would read a column from the ROM table, activate the corresponding ejector 18, index to the next column, and repeat until the end of the table is reached. Then the logic would start reading again from the start of the ROM table. Multiple ROM tables could be stored in a ROM and selected by digital inputs as described above.

For some applications, such as ink jet printing, a delay may be added to the sequencer to prevent too much ink from being ejected when the ink jet printer is initially activated. The delay may be implemented by a counter in the substrate or by a resistor/capacitor network placed in the substrate 24A–D or on the flexible circuit 22A–D.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A micro miniature fluid ejecting device, comprising:

a semiconductor substrate having fluid ejectors formed on a surface of the substrate;

a flexible circuit fixedly attached to the semiconductor substrate, the flexible circuit having power contacts for providing power to the fluid ejectors on the surface of the substrate;

at least one drive circuit connected to the fluid ejectors, the at least one drive circuit disposed on one of the semiconductor substrate and the flexible circuit;

a fluid sequencer connected to the at least one drive circuit for selectively activating the fluid ejectors in a repeating sequence, the fluid sequencer disposed on one of the semiconductor substrate and the flexible circuit;

a housing to which the semiconductor substrate is attached; and a fluid source for supplying fluid to the semiconductor substrate for ejection by the fluid ejectors.

2. The micro-miniature fluid ejecting device according to claim 1, wherein the micro-machined fluid ejectors are thermal fluid ejectors.

3. The micro-miniature fluid ejecting device according to claim 1, wherein the micro-machined fluid ejectors are piezoelectric fluid ejectors.

4. The micro-miniature fluid ejecting device according to claim 1, wherein the ejector sequencer controls a power on time for each of the one or more fluid ejectors.

5. The micro-miniature fluid ejecting device according to claim 1, wherein the ejector sequencer controls a delay time before power on for each of the one or more fluid ejectors.

6. The micro-miniature fluid ejecting device according to claim 1, wherein the ejector sequencer selects a single fluid ejector for activation.

7. The micro-miniature fluid ejecting device according to claim 1, further comprising an oscillator substantially permanently connected to the ejector sequencer.

8. The micro-miniature fluid ejecting device according to claim 7, wherein the oscillator is on the surface of the semiconductor substrate.

9. The micro-miniature fluid ejecting device according to claim 7, wherein the oscillator is on the flexible circuit.

10. The micro-miniature fluid ejecting device according to claim 1, wherein the drive circuits are on the surface of the substrate.

11. The micro-miniature fluid ejecting device according to claim 1, wherein the ejector sequencer is on the surface of the substrate.

12. The micro-miniature fluid ejecting device according to claim 1, wherein the ejector sequencer, the drive circuits, or the ejector sequencer and drive circuits are on the flexible circuit.

13. The micro-miniature fluid ejecting device according to claim 1, further comprising a delay generator that disables the fluid ejectors for a predetermined period of time on start-up.

14. The micro-miniature fluid ejecting device according to claim 1, further comprising one or more fluid ejector disable devices, whereby selective groups of fluid ejectors are disabled from activation.

15. The micro-miniature fluid ejecting device according to claim 1, wherein the ejector sequencer comprises a serial shift register.

16. The micro-miniature fluid ejecting device according to claim 1, wherein the ejector sequencer selects the fluid ejectors according to a ROM table.

17. The micro-miniature fluid ejecting device according to claim 1, wherein the ejector sequencer selects the fluid ejectors according to a non-volatile RAM table.

18. The micro-miniature fluid ejecting device according to claim 1, further comprising selectable delay time devices connected to the substrate for providing delay times between ejections.

19. The micro-miniature fluid ejecting device according to claim 18, wherein the delay time devices are connected to digital logic for selecting delay times between ejections.

20. The micro-miniature fluid ejecting device according to claim 18, wherein the delay time devices are connected to an analog to digital converter for selecting delay times between ejections.

21. The micro-miniature fluid ejecting device according to claim 1, wherein the fluid ejectors are arranged radially from a single point, on the surface of the substrate.

22. The micro-miniature fluid ejecting device according to claim 1, wherein the fluid ejectors are arranged in two or more substantially linear arrays on the surface of the substrate.

23. The micro-miniature fluid ejecting device according to claim 1, wherein the fluid ejectors are arranged in two or more curved arrays on the surface of the substrate.

24. The micro-miniature fluid ejecting device according to claim 1, wherein the fluid is an ink jet ink.

25. A micro-miniature fluid ejector head assembly comprising:

a semiconductor substrate having a plurality of fluid ejectors formed on a surface of the substrate;

a flexible circuit fixedly attached to the semiconductor substrate, the flexible circuit having power contacts for providing power to the fluid ejectors on the surface of the substrate;

at least one drive circuit connected to the fluid ejectors, the at least one drive circuit disposed on one of the semiconductor substrate and the flexible circuit;

a fluid sequencer connected to the at least one drive circuit for selectively activating the fluid ejectors, the fluid sequencer disposed on one of the semiconductor substrate and the flexible circuit; and an oscillator connected to the fluid sequencer for providing a clock signal input to the fluid sequencer.

26. The micro-miniature fluid ejector head assembly according to claim 25, wherein the oscillator is on the surface of the semiconductor substrate.

27. The micro-miniature fluid ejector head assembly according to claim 25, wherein the fluid ejectors are arranged in a single linear array.

28. The micro-miniature fluid ejector head assembly according to claim 25, wherein the fluid ejectors are arranged radially from a single point, on the surface of the substrate.

29. The micro-miniature fluid ejector head assembly according to claim 25, wherein the fluid ejectors are arranged in two or more curved arrays on the surface of the substrate.

30. The micro-miniature fluid ejector head assembly according to claim 25, wherein the ejector sequencer, the drive circuits, or the ejector sequencer and drive circuits are on the flexible circuit.

31. An ink jet printer containing the micro-miniature fluid ejector head assembly of claim 25.

32. Ink jet printhead chip, comprising:

one or more fluid ejectors formed on a surface of the chip;

one or more fluid ejector drive circuits substantially permanently connected to the fluid ejectors; and an oscillator substantially permanently connected to the drive circuits.

33. The ink jet printhead chip according to claim 32, further comprising an ejector sequencer substantially permanently connected to the drive circuits.

* * * * *